US011053819B2

(12) United States Patent
Benn et al.

(10) Patent No.: US 11,053,819 B2
(45) Date of Patent: Jul. 6, 2021

(54) VALVE BRIDGE SYSTEMS COMPRISING VALVE BRIDGE GUIDE

(71) Applicant: Jacobs Vehicle Systems, Inc., Bloomfield, CT (US)

(72) Inventors: Steven Benn, Storrs, CT (US); Dong Yang, West Hartford, CT (US); Gabriel S. Roberts, Wallingford, CT (US); Bruce A. Swanbon, Tolland, CT (US); Justin D. Baltrucki, Canton, CT (US); John Mandell, Vernon, CT (US)

(73) Assignee: JACOBS VEHICLE SYSTEMS, INC., Bloomfield, CT (US)

( * ) Notice: Subject to any disclaimer, the term of this patent is extended or adjusted under 35 U.S.C. 154(b) by 0 days.

(21) Appl. No.: 15/929,504

(22) Filed: May 6, 2020

(65) Prior Publication Data

US 2020/0263571 A1 Aug. 20, 2020

Related U.S. Application Data

(63) Continuation-in-part of application No. 16/676,140, filed on Nov. 6, 2019.

(Continued)

(51) Int. Cl.
*F01L 1/26* (2006.01)
*F01L 1/12* (2006.01)

(Continued)

(52) U.S. Cl.
CPC *F01L 1/26* (2013.01); *F01L 1/12* (2013.01); *F01L 13/06* (2013.01); *F01L 13/08* (2013.01)

(58) Field of Classification Search
CPC ..... F01L 1/181; F01L 1/26; F01L 1/46; F01L 13/06; F01L 13/08

(Continued)

(56) References Cited

U.S. PATENT DOCUMENTS 3,633,556 A 1/1972 Inoue
3,963,004 A 6/1976 Lysinger et al.

(Continued)

FOREIGN PATENT DOCUMENTS

CN 203515707 U 4/2014
JP S53090706 U 12/1976

(Continued)

OTHER PUBLICATIONS

International Search Report for International App. No. PCT/US2019/060129 dated Mar. 17, 2020, 3 pages.

(Continued)

*Primary Examiner* — Jorge L Leon, Jr.
(74) *Attorney, Agent, or Firm* — Moreno IP Law LLC

(57) ABSTRACT

A valve bridge system comprises a valve bridge configured to extend between at least two engine valves of an internal combustion engine. In one embodiment, a valve bridge guide is operatively connected to the valve bridge and configured to extend between at least two valve springs respectively corresponding to the at least two engine valves, the valve bridge guide defining a surface conforming to a valve spring of the at least two valve springs. In another embodiment, the valve bridge guide may comprise at least a first member maintained in a first fixed position relative to and at a predetermined distance from the valve bridge. In both embodiments, the valve bridge guide is configured to avoid contact with the valve bridge in a controlled state, but to permit contact with valve bridge to resist uncontrolled movement of the valve bridge.

3 Claims, 21 Drawing Sheets

Related U.S. Application Data

(60) Provisional application No. 62/756,398, filed on Nov. 6, 2018.

(51) Int. Cl.
*F01L 13/08* (2006.01)
*F01L 13/06* (2006.01)

(58) Field of Classification Search
USPC ..... 123/90.22, 90.4
See application file for complete search history.

(56) References Cited

U.S. PATENT DOCUMENTS

| | | | | |
|---|---|---|---|---|
| 4,327,677 | A | 5/1982 | Vander Bok | |
| 5,261,361 | A | 11/1993 | Speil | |
| 5,535,710 | A | 7/1996 | Zoschke et al. | |
| 6,032,627 | A | 3/2000 | Brogdon et al. | |
| 2009/0064955 | A1 | 3/2009 | Rauch et al. | |
| 2009/0139477 | A1 | 6/2009 | Wotherspoon et al. | |
| 2010/0037854 | A1* | 2/2010 | Yang | F01L 13/06 123/321 |
| 2012/0024260 | A1 | 2/2012 | Groth et al. | |
| 2013/0319370 | A1 | 12/2013 | Yang | |
| 2014/0083381 | A1* | 3/2014 | Roberts | F01L 1/08 123/90.15 |
| 2014/0165941 | A1 | 6/2014 | Yoon et al. | |
| 2014/0326212 | A1 | 11/2014 | Baltrucki et al. | |
| 2015/0159520 | A1* | 6/2015 | Cecur | F01L 1/2411 123/90.12 |
| 2018/0003088 | A1* | 1/2018 | Nielsen | F01L 1/181 |
| 2018/0094553 | A1 | 4/2018 | Nair et al. | |
| 2018/0051597 | A1 | 10/2018 | Nair et al. | |
| 2019/0055861 | A1* | 2/2019 | Persson | F01L 1/2411 |
| 2019/0242278 | A1* | 8/2019 | Zurk | F01L 3/20 |
| 2019/0257218 | A1 | 8/2019 | Voges | |
| 2019/0360362 | A1* | 11/2019 | Cecil | F01L 1/2411 |

FOREIGN PATENT DOCUMENTS

| | | | |
|---|---|---|---|
| JP | 57186010 | A | 11/1982 |
| JP | 08226419 | A | 9/1996 |
| WO | 9602739 | A1 | 1/1996 |

OTHER PUBLICATIONS

Written Opinion of the International Searching Authority for International App. No. PCT/US2019/060129 dated Mar. 17, 2020, 3 pages.

* cited by examiner

VALVE BRIDGE SYSTEMS COMPRISING VALVE BRIDGE GUIDE

FIELD

The instant disclosure relates generally to valve actuation systems in internal combustion engines and, in particular, to valve bridge systems comprising a valve bridge guide used in conjunction with such valve actuation systems.

BACKGROUND

Valve actuation systems for use in internal combustion engines are well known in the art. Such valve actuation systems typically include a valve train that, in turn, comprises one or more components that transfer valve actuation motions from a valve actuation motion source (e.g., one or more cams) to an engine valve. A component often found in valve trains are so-called valve bridges comprising devices that span two or more engine valves associated with a given cylinder. In many cases, such valve bridges permit another component of a valve train (e.g., a rocker arm) to simultaneously actuate the two more engine valves engaged with the valve bridge. Ideally, in operation, opposition of forces applied by a motion-conveying component (such as a rocker arm) and by engine valve springs ensures that a valve bridge remains in contact (with allowances for normal lash settings) simultaneously with the motion-conveying component and with the engine valves. In this manner, the valve bridge is consistently maintained in alignment with, and positioned to convey valve actuation motions to, the engine valves. As used herein, this state of the valve bridge is referred to as a "controlled state" of the valve bridge relative to the engine valves.

Some valve actuation systems are configured to provide so-called auxiliary valve actuation motions, i.e., valve actuation motions other than or in addition to the valve actuation motions used to operate an engine in a positive power production mode through the combustion of fuel. In such valve actuation systems, a valve bridge may be configured to include devices or lost motion assemblies that permit valve actuation motions to be transmitted through the valve bridge to the engine valves, or selectively "lost" where such motions are not transmitted through the valve bridge to the engine valves. FIG. 1 illustrates such a system described in U.S. Patent Application Publication No. 2012/0024260, the teachings of which are incorporated herein by this reference. In this case, a valve bridge 710 is provided with a lost motion assembly in the form of a locking mechanism. In the illustrated embodiment, the locking mechanism comprises a ball 740 that may be forced through an opening in an outer plunger 720 and into engagement with a recess 770 formed in the body of the valve bridge. In this state, the ball 740 is prevented from disengaging the recess 770 due to an outer diameter of an inner plunger 760, thereby locking the outer plunger 720 into a fixed relationship relative to the valve bridge 710. Consequently, any valve actuation motions applied to the outer plunger 720 by a rocker arm 200/400 is conveyed to the valve bridge 710 and to the engine valves 810/910, 820/920. However, when a recess formed in the inner plunger 760 is aligned with ball 740, the ball is able to disengage the recess 770 in the valve bridge 710, thereby unlocking the outer plunger 720 and allowing it to reciprocate relative to the valve bridge 710. In this state, any valve actuation motions applied to the outer plunger 720 cause the outer plunger to move within the valve bridge 710 and are not conveyed to the engine valves. Another valve bridge-based locking/unlocking system is disclosed in U.S. Patent Application Publication No. 2014/0326212, the teachings of which are incorporated herein by this reference.

However, in systems of the type illustrated in FIG. 1, the possibility exists for partial engagement of the locking mechanism. In this case, it is possible for valve actuation motions to be initially applied to the engine valves, thereby causing the engine valves to lift off their valve seats. Due to the partial engagement of the locking mechanism, however, increased loading or vibration in the valve actuation system causes the locking mechanism to quickly switch from the partially locked to an unlocked state. When this happens, the force provided by the valve actuation motions to open the engine valves is suddenly removed, permitting the engine valves to rapidly accelerate to a closed position in an unrestrained manner under the considerable force of the valve springs. When the engine valves reach the fully closed position (i.e., stopped against the valve seats formed in the cylinder head), the momentum applied to the valve bridge can cause the valve bridge to continue on an uncontrolled trajectory generally in a direction away from the engine valves until hitting the rocker arm or some other object. In fact, it is possible for the valve bridge to come off of either of the tips of the engine valves such that the valve bridge is dislodged from the engine valves, thereby causing engine damage. Movement of this type is referred to as "uncontrolled movement" of a valve bridge and, as used herein, this state of the valve bridge is referred to as an "uncontrolled state" of the valve bridge relative to the engine valves. It is also known for uncontrolled states of valve bridges to occur as a result of overspeed operation of an internal combustion engine.

Given this potential for malfunctioning, solutions that prevent, minimize or accommodate uncontrolled states of valve bridges (regardless of the cause) would represent a welcome addition to the art.

SUMMARY

The instant disclosure describes valve bridge systems that overcome the above-described problems with prior art valve bridge systems. In a first primary embodiment, a valve bridge system comprises a valve bridge configured to extend between at least two engine valves of an internal combustion engine. A valve bridge guide is operatively connected to the valve bridge and comprises a valve bridge control surface for selectively contacting at least one of the valve bridge or engine valve assembly (comprising the at least two engine valves, at least two valve springs corresponding to the at least two engine valves and at least two spring retainers corresponding to the at least two engine valves). In this embodiment, the valve bridge guide may be out of a moldable polymer. The valve bridge control surface is configured to avoid contact with the valve bridge or the engine valve assembly when the valve bridge is in a controlled state relative to the at least two engine valves and further configured to contact the valve bridge or the engine valve assembly to resist uncontrolled movement of the valve bridge when the valve bridge is in an uncontrolled state relative to the at least two engine valves. In an embodiment, the valve bridge guide is configured to extend between the at least two valve springs, where the valve bridge control surface is at least one concave surface corresponding to at least one convex surface defined by the at least two valve springs or the at least two spring retainers, or a convex surface defined by a portion of the valve bridge. More particularly, each of the at least one concave surfaces may be delimited by opposite edges such that a line intersecting the opposition edges forms a secant relative to outer diameters of corresponding ones of the at least two valve springs or the at least two spring retainers.

The valve bridge guide and valve bridge may form a unitary structure, or the valve bridge guide may comprise one or more separate components operatively connected to the valve bridge. In an embodiment, the valve bridge guide comprises two guide members configured to engage opposite sides of the valve bridge, and may further comprise at least one fastener for operatively coupling the two guide members together. The valve bridge guide may comprise an opening to receive at least a portion of the valve bridge, and may further comprise at least two protruding members, each of the at least two protruding members projecting from the valve bridge guide toward the valve bridge and extending past at least a lower surface of the valve bridge facing the at least two engine valves. Further, the at least two protruding members may define the valve bridge control surface. Alternatively, each of the at least two protruding members may comprise an attachment surface for engaging a corresponding surface of the valve bridge.

In a second primary embodiment, the valve bridge system may comprise a valve bridge configured to extend between at least two engine valves of an internal combustion engine, the valve bridge comprising a lower surface facing the at least two engine valves and an upper surface opposite the lower surface. The system of this primary embodiment further comprises a valve bridge guide having a first member maintained in a first fixed position relative to the valve bridge, the first member comprising a first surface facing and at a predetermined distance from the upper surface of the valve bridge when the at least two engine valves are in a closed state. The predetermined distance is configured to prevent contact between the first surface and the upper surface of the valve bridge when the upper bridge body is in a controlled state relative to the at least two engine valves, and to permit contact between the first surface and the upper surface of the valve bridge to resist uncontrolled movement of the valve bridge when the valve bridge is in an uncontrolled state relative to the at least two engine valves. Where the valve bridge comprises a receptacle to receive an engine valve tip of one of the at least two engine valves, the predetermined distance may be less than a depth of the receptacle.

The first fixed position of the first member may be in alignment with a first engine valve of the at least two engine valves, the first engine valve being farthest from a rocker shaft of the internal combustion engine. The valve bridge system may further comprise a second member maintained in a second fixed position relative to the valve bridge, the second member comprising a second surface facing and at the predetermined distance from the upper surface of the valve bridge. In this case, the second fixed position of the second member is in alignment with a second engine valve of the at least two engine valves, the second engine valve being closest to a rocker shaft of the internal combustion engine. The first member may be configured for attachment to a cylinder head of the internal combustion engine, whereas the second member may form a unitary structure with a rocker shaft pedestal of the internal combustion engine.

In further alternatives of this second primary embodiment, the valve bridge guide may further comprise a bridge pin disposed in one end of the valve bridge and in alignment with an engine valve of the at least two engine valves. Alternatively, the first member of the valve bridge guide in this embodiment may comprise an arch, configured for attachment to the cylinder head, extending between the at least two engine valves and over the upper surface of the valve bridge, the arch further comprising an opening formed therein aligned with a portion of the valve bridge contacting a valve train component.

BRIEF DESCRIPTION OF THE DRAWINGS

The features described in this disclosure are set forth with particularity in the appended claims. These features and attendant advantages will become apparent from consideration of the following detailed description, taken in conjunction with the accompanying drawings. One or more embodiments are now described, by way of example only, with reference to the accompanying drawings wherein like reference numerals represent like elements and in which:

DETAILED DESCRIPTION OF THE PRESENT EMBODIMENTS

FIGS. 2-36 illustrate various embodiments of valve bridge systems comprising valve bridge guides in accordance with the instant disclosure. In all of the embodiments and variations illustrated in FIGS. 2-36, it is assumed that valve bridges are of the type illustrated in FIG. 1, i.e., valve bridges having locking mechanisms of the general type illustrated in FIG. 1 and described above.

Figure 2:
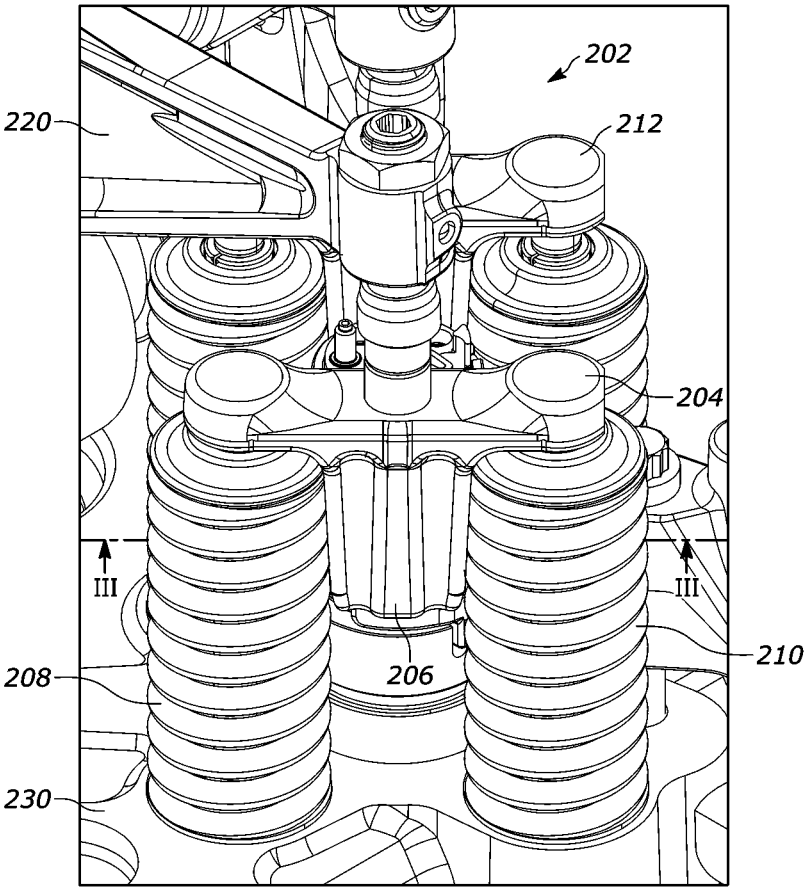
FIGS. 2 and 3 are respective top, isometric and bottom, isometric, cross-sectional views of a first primary embodiment of a valve actuation system comprising a valve bridge and valve bridge guide in accordance with the instant disclosure.

FIG. 2 illustrates a first embodiment in accordance with the instant disclosure in which an internal combustion engine 202 comprises a pair of valve bridges 204, 212 for a single cylinder. In the illustrated embodiment, each valve bridge 204, 212 actuates two corresponding engine valves, though it is possible for each valve bridge to actuate more than two engine valves. As known in the art, each valve bridge 204, 212 (or any of the other valve bridges illustrated and described herein) may actuate two engine valves of the same type, i.e., two intake or two exhaust valves. For ease of illustration, the features and operation of only a first valve actuation system in accordance with the first embodiment is described, it being understood that the described features and operation are equally applicable to all valve bridges included in the internal combustion engine.

Thus, as shown, a first valve bridge 204 spans a pair of engine valves (not visible in FIG. 2) in a conventional manner as known in the art. Each engine valve has a valve spring 208, 210 that biases its corresponding engine valve into a closed state (i.e., with the engine valve head engaged with a valve seat formed in a cylinder head 230) and a valve spring retainer 209, 211 attached to valve stems of the engine valves. As further shown, the valve bridge system 202 further comprises a valve bridge guide 206 that extends downward (i.e., in the direction of the cylinder head and away from a rocker arm 220) from the valve bridge 204 and between the valve springs 208, 210. In an embodiment, the distance that the valve bridge guide 206 extends between the valve springs 208, 210 is minimally dictated by that portion of the valve bridge 204 enclosing the locking mechanism (e.g., with reference to FIG. 1, the depth of that portion of the valve bridge housing the outer plunger 720 and outer plunger spring 746). In the embodiment illustrated in FIG. 2, the valve bridge and the valve bridge guide form a unitary structure, i.e., parts of an undivided whole, such that the locking mechanism is housed within an opening (best shown in FIG. 3) formed in the valve bridge 204 and valve bridge guide 206. As described in greater detail below, the valve bridge guide 206 comprises at least one valve bridge control surface configured to interact with one or both of the valve springs 208, 210 or valve spring retainers 209, 211 to prevent, minimize or at least accommodate uncontrolled motion of the valve bridge 204.

Figure 3:
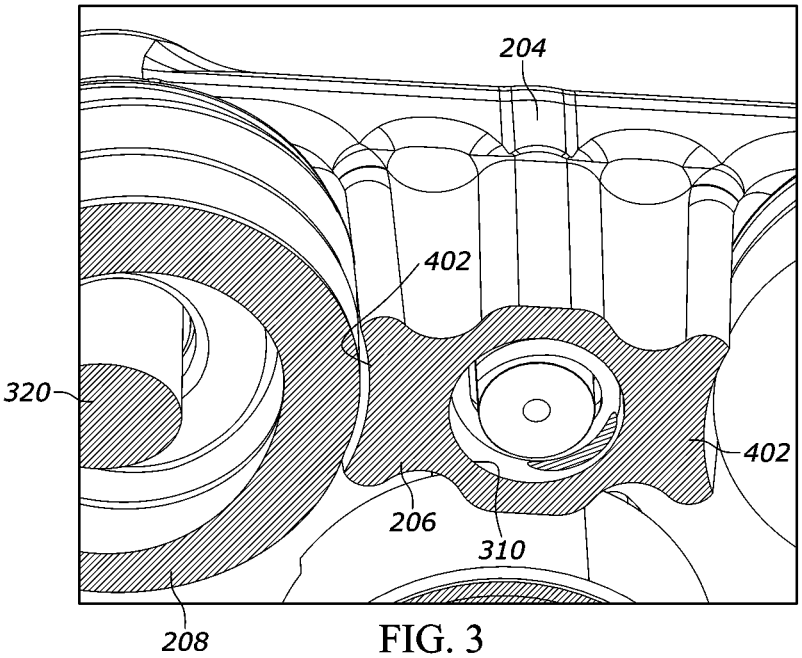

FIG. 3 illustrates a cross-sectional view of the valve bridge guide 206 and a first valve spring 208 taken along section line III-III (as shown in FIG. 2). An opening 310 for housing the locking mechanism is formed in the valve spring guide 206 and FIG. 3 further illustrates a valve stem 320 disposed within a corresponding valve spring 208. More particularly, FIG. 3 illustrates two valve bridge control surfaces 402 defined by the valve bridge guide 206 such that the valve bridge control surfaces 402 conform to corresponding valve springs 208, 210 (only one shown in FIG. 3), i.e., the valve bridge control surfaces 402 are concave surfaces relative to the convex outer surface of the valve springs 208, 210. Though conforming, the valve bridge control surfaces 402 are configured so that, during a controlled state of the valve bridge, the valve bridge control surfaces 402 (and, consequently, the valve bridge guide 206) are able to avoid contact with their corresponding valve springs 208, 210. The valve bridge control surfaces 402 may be configured so as to be as close as possible to the valve springs 208, 210 (within manufacturing tolerances) such that normal movement and vibrations of the valve bridge 204, valve bridge guide 206 and the valve springs 208, 210 are insufficient to cause contact between the valve bridge control surfaces 402 and the valve springs 208, 210. For example, as known in the art, when compression springs such as the valve springs 208, 210 are deformed (i.e., compressed), the outer diameter of the spring will increase slightly. Thus, the valve bridge control surfaces 402 may be configured to account for the maximum expected changes in the spring diameters while remaining as close as possible to the valve springs 208, 210.

In sonic instances, it may not be desirable for the valve bridge guide 206 to contact the valve springs 208, 210, which could otherwise lead to early degradation of the valve springs 208, 210. Thus, it may be desirable to instead configure the valve bridge control surfaces 402 to contact the spring retainers 209, 211. To implement this configuration, it may be necessary to dimension the spring retainers 209, 211 to have outer diameters that are larger than outer diameters of the valve springs 208, 210. In this case, the valve bridge control surfaces 402 are instead defined by the valve bridge guide 206 such that the valve bridge control surfaces 402 conform to corresponding spring retainers 209, 211, i.e., the valve bridge control surfaces 402 are concave surfaces relative to convex outer surfaces of the spring retainers 209, 211. Once again, such concave surfaces are configured such that, during a controlled state of the valve bridge, the valve bridge control surfaces 402 are able to avoid contact with their corresponding spring retainers 209, 211, and are further configured so as to be as close as possible to the valve springs 208, 210 (within manufacturing tolerances) such that normal movement and vibrations of the valve bridge 204, valve bridge guide 206 and the valve springs 208, 210 are insufficient to cause contact between the valve bridge control surfaces 402 and the spring retainers 209, 211.

Though the various Figures illustrated and described in this disclosure show at least two concave valve bridge control surfaces 402, this is not necessarily a requirement. For example, a single such valve bridge control surface 402 may be employed if used in conjunction with another feature that provide additional control of otherwise uncontrolled movements of the valve bridge 204. For example, in the case where the valve bridge 204 is equipped with a bridge pin (see, e.g., FIG. 21, element 2102), the combination of a single valve bridge control surface 402 and the bridge pin may be sufficient.

Figure 4:
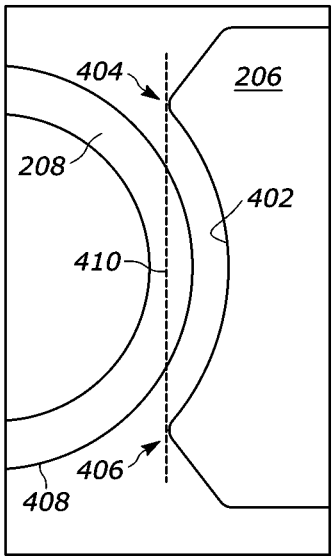
FIG. 4 is a schematic drawing illustrating a relationship between a valve spring and a surface of the valve bridge guide in accordance with the first primary embodiment.

Configuration of the valve bridge control surfaces 402 in accordance with a preferred embodiment is further described relative to FIG. 4, which schematically illustrates the valve bridge guide 206 and a valve spring 208 in magnified form. (Alternatively, as described above, the valve spring 208 illustrated in FIG. 4 could be considered a spring retainer though, for ease of description, only a valve spring 208 is described herein.) As shown, the valve bridge guide 206 comprises the concave valve bridge control surface 402 in proximity to an outer circumference 408 of the valve spring 208. In practice, the clearance between the valve bridge control surface 402 and the outer circumferen 408 is based in part upon manufacturing tolerances of the valve springs 208, 210 (or spring retainers 209, 211) and valve bridge 204. Additionally, this clearance is based on the clearance of engine valve tips within receptacles formed in the valve bridge 204 to receive the engine valve tips. For example, if the valve bridge 204 is allowed to move ±0.25 mm, then the clearance between to the valve spring 208 and valve bridge control surface 402 should be larger than the tolerance of the parts plus the permitted 0.25 mm of play. Further, chamfer at the bottom of the valve bridge 204 should be large enough such that, if the valve bridge 204 experiences uncontrolled movement over the full clearance to the valve spring or spring retainer, the valve bridge 204 can still reposition itself on the engine valve tips.

As further shown in FIG. 4, the circumferential length of the concave valve bridge control surface 402 (relative to the outer circumference 408 of the spring 208) is delimited by opposite edges 404, 406. In this preferred embodiment, the opposite edges 404, 406 are spaced apart to a degree such that, when the valve bridge guide 206 is positioned during a controlled state of the valve bridge 204, a line 410 intersecting the opposite edges 404, 406 as shown forms a secant relative to at least the outer circumference 408 of the valve spring 208. Configured in this manner, it will be appreciated that movement of the valve bridge guide 206 in either direction indicated by line 410 (such as might occur, for example, during an uncontrolled state of the valve bridge 204) will result, if large enough, in contact between the concave valve bridge control surface 402 and the spring outer circumference 408 such that the valve bridge guide 206 will deflect generally in a direction away from the valve spring 208 and toward the other valve spring 210. More generally, any rotary motion of the valve bridge 204 about the axis of the locking mechanism centerline is constrained as well as lateral movement in both horizontal planes. With this in mind, and referring back to FIGS. 2 and 3, this operation of the concave valve bridge control surfaces 402 during an uncontrolled state of the valve bridge 204 will tend to cause the valve bridge guide 206 to realign itself with valve springs 208, 210, thereby effectively dampening or even eliminating any uncontrolled movement of the valve bridge 204 and valve bridge guide 206.

Figure 5:
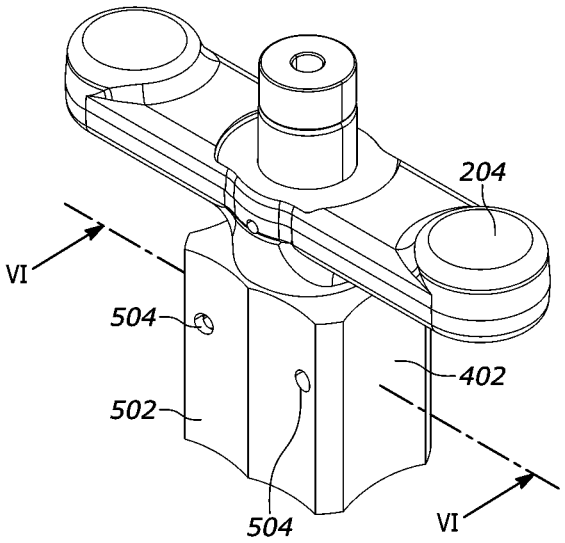
FIGS. 5 and 6 are respective isometric and cross-sectional (along section line VI-VI) views of a valve bridge and valve bridge guide in accordance with a first variation of the first primary embodiment.
Figure 6:
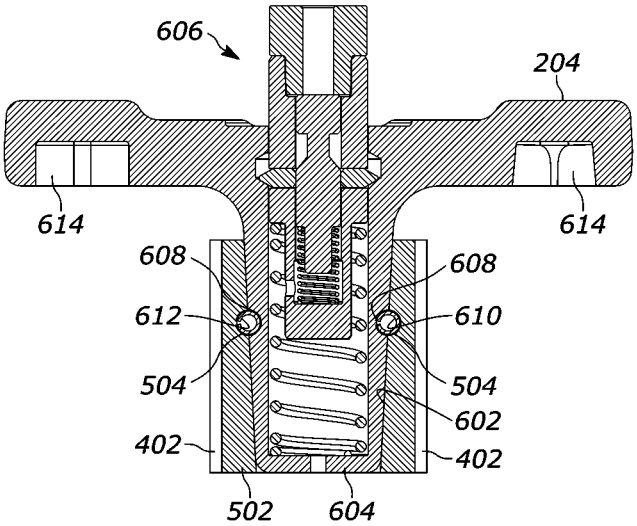

Referring now to FIGS. 5 and 6, a first variation of a valve bridge guide 502 comprises a unitary body, separate from the valve bridge 204, having valve bridge control surfaces 402 formed on lateral sides thereof, as shown. The valve bridge 204 is also illustrated as having receptacles 614 for receiving valve stem tips of engine valves, as known in the art and described above. In this embodiment (as well as the further embodiments illustrated in FIGS. 7-13), the valve bridge guide 502 may be fabricated from the same material (e.g., steel) as the valve bridge 204, though, in a preferred embodiment, the valve bridge guide 502 is formed of a lighter, strong material that is nevertheless softer than the valve bridge springs 208, 201 (or spring retainers 209, 211) so as to avoid marring or damage. For example, a suitable moldable polymer, as known in the art, may be used for this purpose. Still further types of materials for fabricating the valve bridge guide will be apparent to those skilled in the art.

Regardless, as further shown, the valve bridge guide 502 has an opening or bore 602 formed therein configured to snugly receive a portion 604 of the valve bridge 204. As shown, the portion 604 of the valve bridge 204 received by the valve bridge guide 502 preferably houses at least some of the locking mechanism 606. As further shown, in this embodiment, both the valve bridge guide 502 and the portion 604 of the valve bridge 204 comprise a fastener-receiving feature 504, 608. In this embodiment, the fastener-receiving feature 504 of the valve bridge guide comprises a bore that intersects with the opening 602 formed in the valve bridge guide 502. Thus, where the bore intersects with the opening 602, the fastener-receiving feature 504 essentially comprises a channel having a semi-circular cross section formed in a sidewall of the opening 602. In complementary fashion, the fastener-receiving feature 608 of the portion 604 of the valve bridge 204 is also formed as a semi-circular channel in an exterior side wall surface of the portion 604. When aligned, these respective fastener-receiving features 504, 608 may receive fasteners 610, 612 such that the valve bridge guide 502 is operatively connected to the portion 604 of the valve bridge 204. For example, in the illustrated embodiment, the fastener 612 may comprise a split dowel pin, as shown, though those skilled in the art will recognize that other types of fasteners, e.g., screws, may be equally employed. In this manner, the valve bridge guide 502 is relatively rigidly attached to the valve bridge 204 such that they move in unison. As an alternative to the fastener embodiment described above, the valve bridge guide 502 (or the other embodiments of the valve bridge guide illustrated in FIGS. 7-13) may instead be securely attached to the valve bridge 204 using a suitably strong and durable epoxy or similar adhesive. Further still, combinations of such techniques may also be employed as a matter of design choice.

Figure 7:
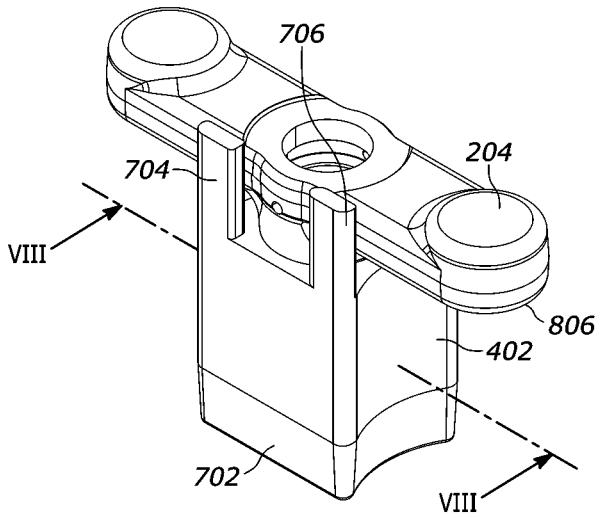
FIGS. 7 and 8 are respective isometric and cross-sectional (along section line VIII-VIII) views of a valve bridge and valve bridge guide in accordance with a second variation of the first primary embodiment.
Figure 8:
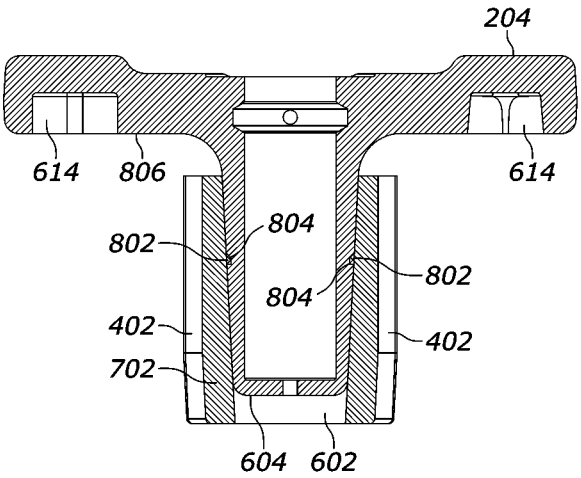

Referring now to FIGS. 7 and 8, a second variation of a valve bridge guide 702 is substantially similar to the valve bridge guide 502 of FIGS. 5 and 6 in that it comprises a unitary body, separate from the valve bridge 204, having valve bridge control surfaces 402 formed on lateral sides thereof, as shown. In this embodiment, however, the valve bridge guide 702 comprises one or more teeth 802 extending inwardly from a sidewall surface of the opening 602 and configured to engage with a notch 804 formed in an outer sidewall surface of the portion 604 of the valve bridge 204. For example, the notch 804 may comprise an annular groove or channel formed in the sidewall of the portion 604 of the valve bridge 204. When the teeth 802 engage the notch 804, the valve bridge guide 702 is once again operatively connected to the valve bridge in relatively rigid fashion such that the valve bridge guide 702 and the valve bridge 204 move in unison. It is noted that, in this embodiment, the deployment of the one or more teeth 802 and notch 804 may be equally reversed, i.e., the teeth 802 may be formed on the outer sidewall surface of the portion 604 of the valve bridge 204 and the notch 804 formed on the inner sidewall surface of the opening 602.

As further shown in FIG. 7, the valve bridge guide 702 may comprise at least two protruding members 704, 706 projecting from the valve bridge guide 702 toward the valve bridge 204. As shown in FIG. 8, the valve bridge 204 has a lower surface 806 and, in an embodiment, the protruding members 704, 706 extend at least past the lower surface 806 of the valve bridge 204. In this embodiment, the at least two protruding members 704, 706 aid in orienting the valve bridge guide 702 on the valve bridge 204, thereby preventing rotation of the valve bridge 204 relative to the valve bridge guide 702. In this manner, at least two protruding members 704, 706 further aid in aligning the valve bridge control surface(s) 402 with the valve springs 208, 210 or spring retainers 209, 211.

Figure 9:
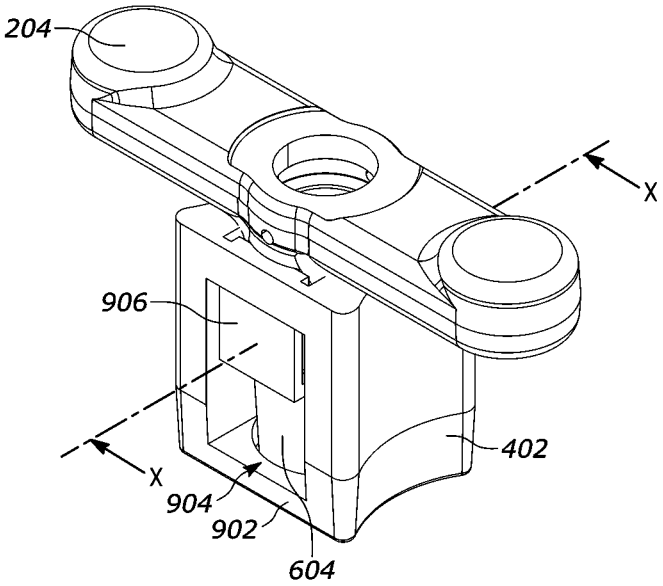
FIGS. 9 and 10 are respective isometric and cross-sectional (along section line X-X) views of a valve bridge and valve bridge guide in accordance with a third variation of the first primary embodiment.
Figure 10:
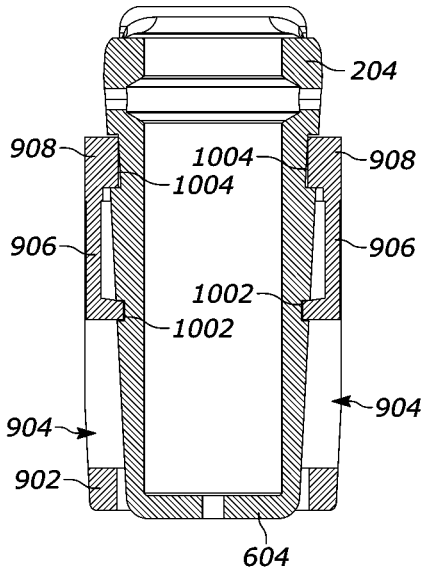

Referring now to FIGS. 9 and 10, a third variation of a valve bridge guide 902 is illustrated in which the valve bridge guide 902 is once again formed as a unitary body, separate from the valve bridge 204, having valve bridge control surfaces 402 formed on lateral sides thereof, as shown. In this embodiment, however, the valve bridge guide 902 has side openings 904 having cantilevered latches or catches 906 disposed therein. As shown, the catches 906 are configured to engage corresponding notches 1002 formed in an outer sidewall surface of the portion 604 of the valve bridge 204. For example, once again, the notches 1002 may comprise an annular groove or channel formed in the sidewall of the portion 604 of the valve bridge 204. When the catches 906 engage the notches 1002, the valve bridge guide 902 is once again operatively connected to the valve bridge 204 in relatively rigid fashion such that the valve bridge guide 902 and the valve bridge 204 move in unison. As shown, the valve bridge guide 902 may further comprise secondary latching surfaces 908 configured to engage corresponding secondary notches 1004 formed in the portion 604 of the valve bridge 204. By providing multiple latching pairs 906, 1002/908, 1004, the stability of the valve bridge guide 902 relative to the valve bridge 204 may be improved.

Figure 1:
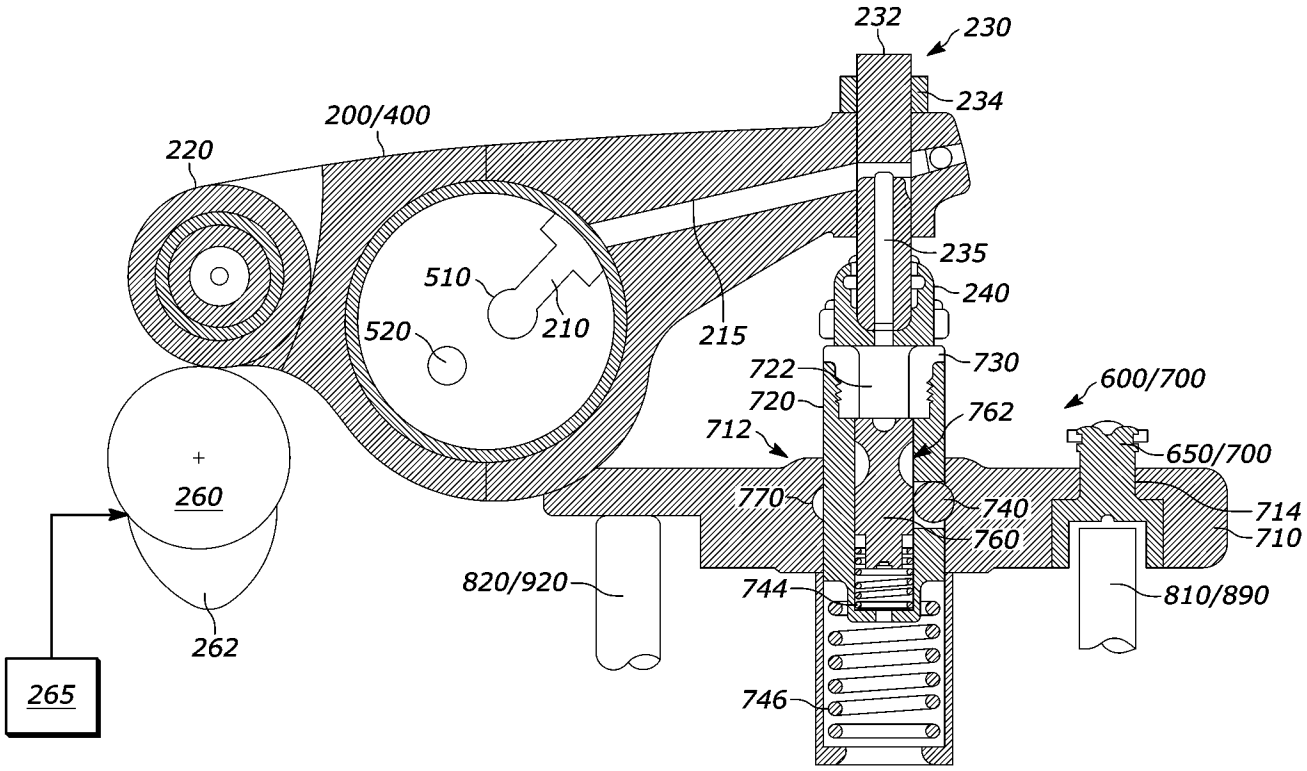
PRIOR ART FIG. 1
FIG. 1 is a cross-sectional illustration of a valve actuation system that includes a valve bridge having a locking mechanism in accordance with prior art.
Figure 11:
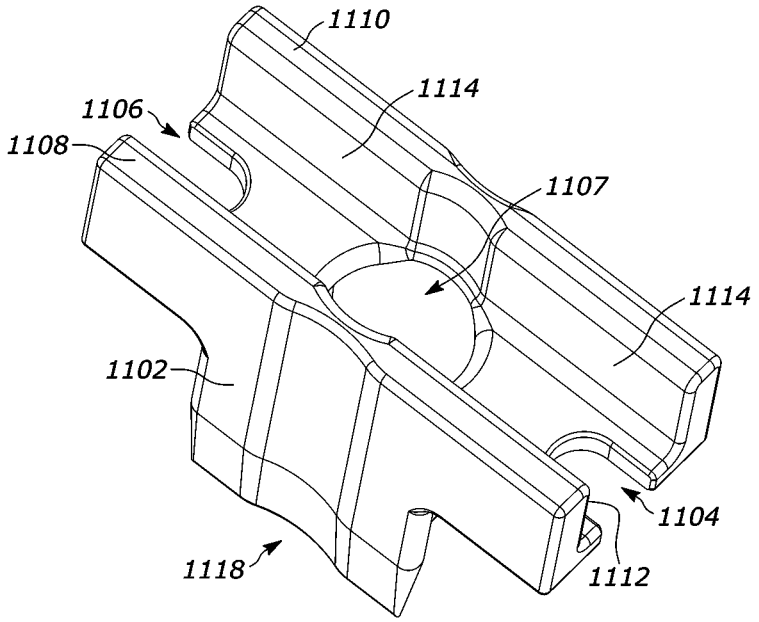
FIG. 11 is an isometric view of a valve bridge guide in accordance with a fourth variation of the first primary embodiment.

Referring now to FIG. 11, a fourth variation of a valve bridge guide 1102 is shown. In this variation, the valve bridge guide 1102 is a unitary body that is disposed between the spring retainers 209, 211 and the valve bridge 204. Notches 1104, 1106 are provided to allow the valve bridge guide 1102 to locate relative to the tips of the engine valves. Additionally, a central opening 1107 may be provided that permits a portion of the valve bridge 204 (e.g., that portion housing the locking mechanism as shown in FIG. 1) to extend through the valve bridge guide 1102. Similar to the embodiment of FIGS. 7 and 8, the valve bridge guide 1102 comprises at least two protruding members in the form of side walls 1108, 1110 that define a channel 1107 that, in turn, is configured to receive the valve bridge 204. In this embodiment, the inner surfaces 1112, 1114 of the side walls 1108, 1110, which rise above the valve bridge 204, serve as valve bridge controls surfaces that prevent lateral movement or rotation of the valve bridge 204 as may result during an uncontrolled state of the valve bridge 204. Further, though not shown in FIG. 11, additional valve bridge control surfaces 402 may be optionally provided on a lower portion 1118 of the valve bridge guide 1102 in order prevent tilting of the valve bridge 204, as described above. To the extent that the valve bridge guide 1102 is securely attached to the valve bridge 204 (using any of the above-described techniques), any excessive lift of the valve bridge 204 (e.g., off of the engine valve tips) will cause a similar lift in the valve bridge guide 1102, which again resists uncontrolled movement and permits the valve bridge 204 to once again settle back onto the engine valve tips.

Figure 12:
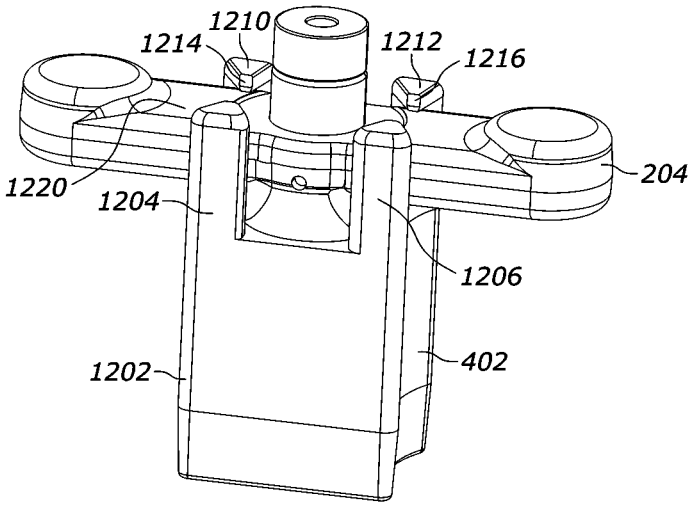
FIG. 12 is an isometric view of a valve bridge and valve bridge guide in accordance with a fifth variation of the first primary embodiment.

Referring now to FIG. 12, a fifth variation of a valve bridge guide 1202 is substantially similar to the valve bridge guide 502 of FIGS. 5 and 6 in that it comprises a unitary body, separate from the valve bridge 204, having valve bridge control surfaces 402 formed on lateral sides thereof, as shown. As further shown, and similar to the second variation illustrate in FIGS. 7 and 8, this embodiment of the valve bridge guide 1202 further comprises a plurality of protruding members 1204-1212 extending upwardly from the main body of the valve bridge guide 1202, which serve similar purposes as described above. Additionally, as shown, each of the protruding members 1204-1212 comprises an attachment surface 1214, 1216 (only two shown in FIG. 12) in the form of inwardly extending fingers 1214, 1216 disposed at terminal ends of the protruding members 1204-1212. The attachment surfaces thus defined are configured to engage a corresponding surface 1220 of the valve bridge 204, in this case, an upper surface of the valve bridge 204. In this manner, the valve bridge guide 1202 is retained on the valve bridge 204. Alternatively, and similar to the embodiment of FIGS. 9 and 10, the fingers 1214, 1216 may instead engage notches or similar features formed in lateral sides of the valve bridge 204.

Figure 13:
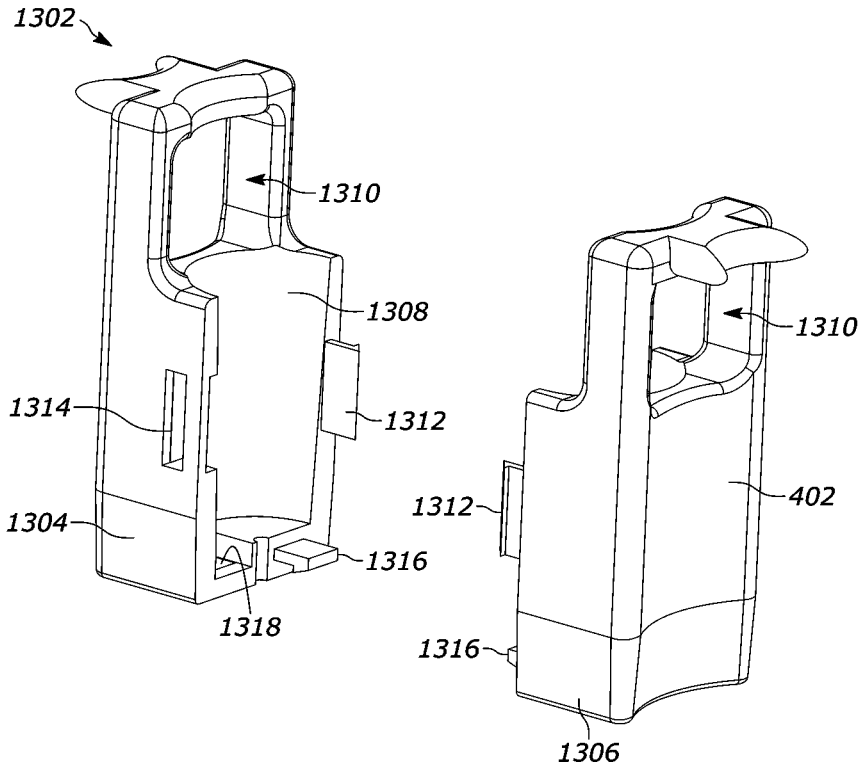
FIG. 13 is an isometric view of a valve bridge guide in accordance with a sixth variation of the first primary embodiment.

FIG. 13 illustrates a sixth variation of the first embodiment in which the valve bridge guide 1302 is formed of two guide members 1304, 1306 configured to engage opposite sides of a valve bridge. As in other embodiments, each of the guide members 1304, 1306 defines a valve bridge control surface 402 as described above. Further, each of the guide members 1304, 1306 defines a first opening 1308 (only one shown) that is configured to receive the portion 604 of the valve bridge 204 (not shown). As further shown, each of the guide members 1304, 1306 also includes a channel or second opening 1310 configured to receive one of the arms of the valve bridge 204 (i.e., that portion of the valve bridge extending from the center of the valve bridge to one of the engine valves). Further still, each of the guide members 1304, 1306 includes fasteners in the form of complementary first latches 1312 and first latch notches 1314 and second latches 1316 and second latch notches 1318 such that the guide members 1304, 1306 may be securely connected to each other. Alternatively, any of the attachment mechanisms described above (dowel pins, epoxies, etc.) may be used as "fasteners" for this purpose. When connected, the guide members 1304, 1306 collectively define the valve bridge guide 1302 that is maintained in position relative to the valve bridge 204 by virtue of the fact that the second openings 1310 encompass the arms of the valve bridge 204.

Figure 14:
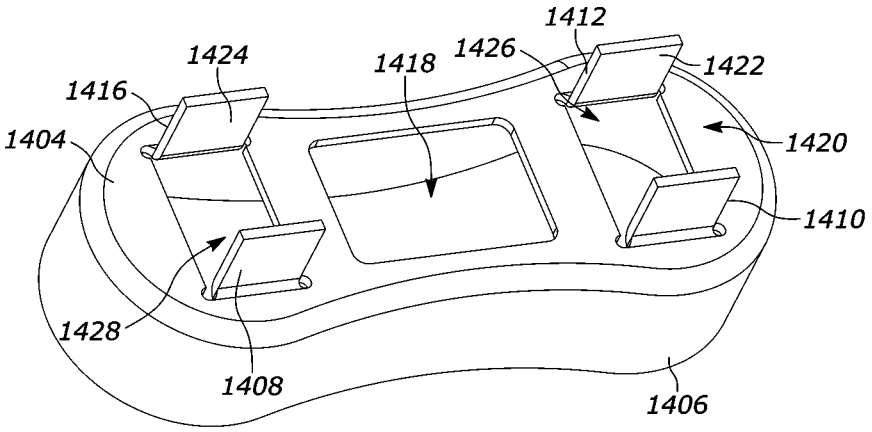
FIGS. 14 and 15 are respective isometric and cross-sectional views of a valve bridge guide in accordance with a seventh variation of the first primary embodiment.
Figure 15:
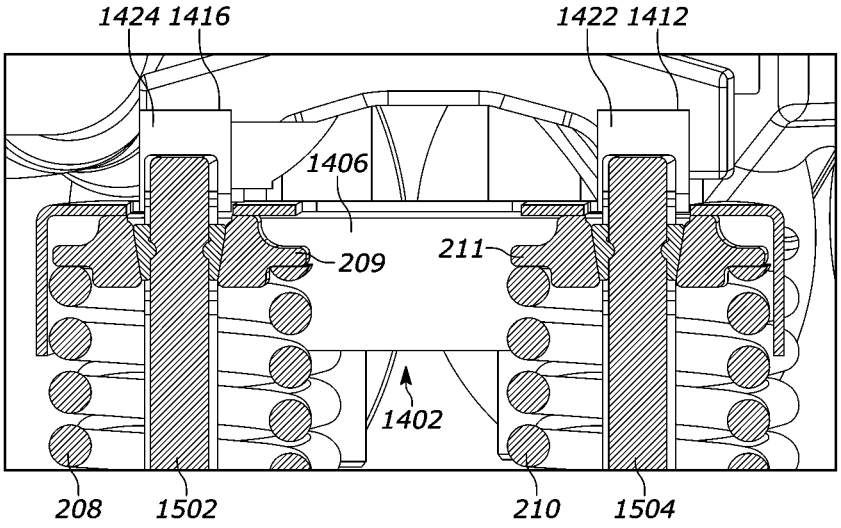

FIGS. 14 and 15 illustrate a seventh variation of the first primary embodiment in which a valve bridge guide 1402 is formed as a stamped sheet metal structure having a horizontal surface 1404 and a continuous sidewall 1406 extending downwardly therefrom. In this variation, and similar to the embodiment illustrated in FIG. 11, the valve bridge guide 1402 is designed to rest on top of the spring retainers 209, 211 (FIG. 15) and beneath the valve bridge 204 (not shown). In FIG. 15, the sidewall 1406 is shown extending past the spring retainers 209, 211 as well as initial portion of the valve springs 208, 210. In an embodiment, the extent of the sidewall 1406 is such that the valve bridge guide 1402 is unable to lift completely off of the spring retainers 209, 211 despite any vertical displacement applied to the valve bridge 204. In addition to a central opening 1418 that permits passage of a portion of the valve bridge 204, the valve bridge guide 1402 also comprises a plurality of protruding members 1408-1416 (four shown in the illustrated example) similar to those illustrated in FIGS. 7, 8, 11 and 12. As shown, the protruding members 1408-1416 are formed as upwardly bent portions of the horizontal surface 1404, which results in openings 1426, 1428 that permit passage of the tips of the engine valves 1502. In this case, the protruding members 1408-1416 once again define valve bridge control surfaces 1422, 1424 for resisting uncontrolled movement of the valve bridge 204.

Figure 16:
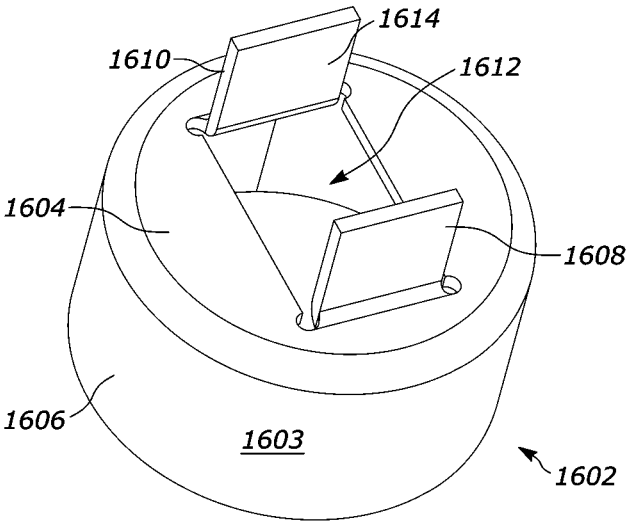
FIG. 16 is an isometric view of a valve bridge guide in accordance with a eighth variation of the first primary embodiment.

FIG. 16 illustrates an isometric view of an eighth variation of the first primary embodiment in which the valve bridge guide 1602 comprises a two guide members 1603 (only one shown) that are configured to engage opposite sides of the valve bridge 204 (not shown). Each guide member 1603 is formed as a stamped sheet metal structure having a horizontal surface 1604 and a continuous sidewall 1606 extending downwardly therefrom, similar to the embodiment of FIGS. 14 and 15, but configured to rest atop only a single spring retainer 209. Once again, each guide member 1603 comprises a plurality of protruding members 1608, 1610 extending upwardly and a central opening 1612 for passage of engine valve tips, where each of the protruding members 1608, 1610 defines valve bridge control surfaces 1614 for resisting uncontrolled movement of the valve bridge 204.

Figure 17:
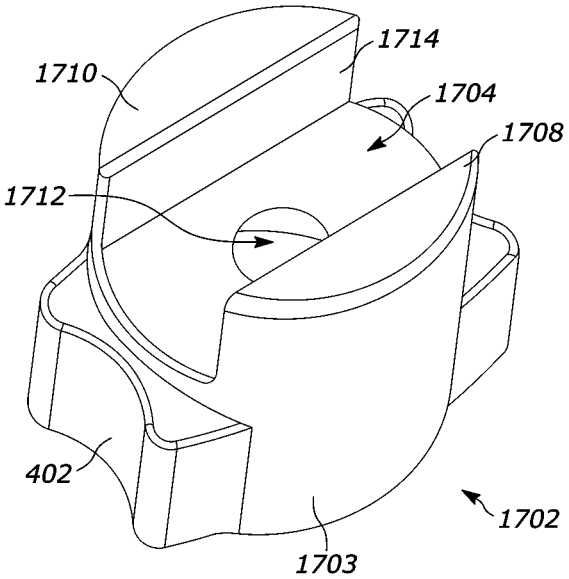
FIG. 17 is an isometric view of a valve bridge guide in accordance with a ninth variation of the first primary embodiment.

Similar to the embodiment of FIG. 16, the embodiment illustrated in FIG. 17 comprises a valve bridge guide 1702 comprising a pair of guide members 1703 configured to rest atop separate spring retainers 209, 211. Formed, in this case, from a moldable polymer, each guide member 1703 comprise a horizontal surface 1704 and a continuous sidewall 1706 extending downwardly therefrom, similar to the embodiments of FIGS. 14 and 15, but configured to rest atop only a single spring retainer 209 as in the embodiment of FIG. 16. Once again, each guide member 1703 comprises a plurality of protruding members 1708, 1710 extending upwardly and a central opening 1712 for passage of engine valve tips, where each of the protruding members 1708, 1710 defines valve bridge control surfaces 1714 for resisting uncontrolled movement of the valve bridge 204. In this case, however, each guide member 1703 is also provided with lateral, concave valve bridge control surfaces 402 as described above. In this case, however, the lateral, concave valve bridge control surfaces 402 are not configured to conform to the outer surfaces of valve springs 208, 210, but to that portion of a the valve bridge 204 extending downwardly between the valve springs 208, 210 and housing the locking mechanism, as described above relative to and illustrated FIG. 1.

Figure 18:
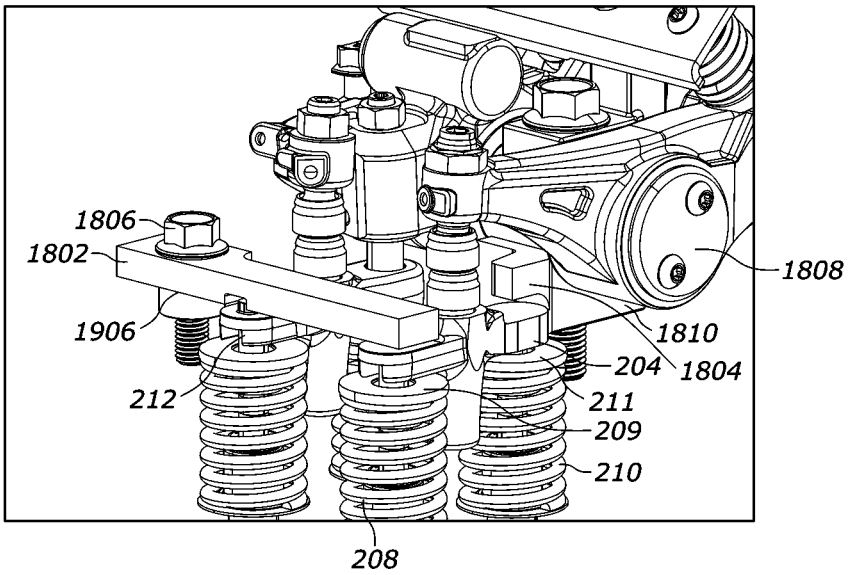
FIGS. 18-21 are respective isometric, side and front views of a valve bridge and valve bridge guide in accordance with a second primary embodiment.
Figure 19:
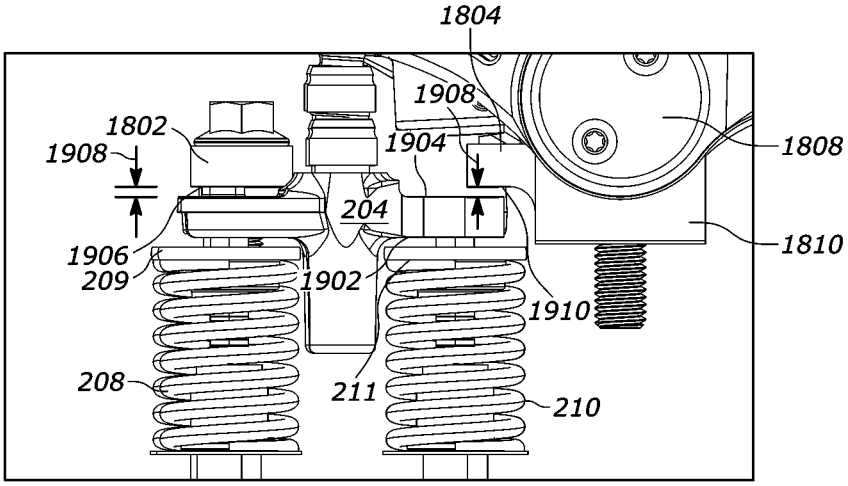

Referring now to FIGS. 18-21, a second primary embodiment in accordance with the instant disclosure is illustrated in which an internal combustion engine 202 comprises a pair of valve bridges 204, 212 for a single cylinder. In the illustrated embodiment, each valve bridge 204, 212 actuates two corresponding engine valves, though, once again, it is possible for each valve bridge to actuate more than two engine valves. In the illustrated embodiment, a first valve bridge 204 spans a pair of engine valves in a conventional manner as known in the art. Each engine valve has a valve spring 208, 210 that biases its corresponding engine valve into a closed state and a valve spring retainer 209, 211 attached to valve stems of the engine valves. As best shown in FIG. 19, the valve bridge 204 comprises a lower surface 1902 facing the engine valves and an upper surface 1904 opposite the lower surface 1902.

As further shown in this second primary embodiment, the valve bridge system further comprises a valve bridge guide in the form of a first member 1802 having a first surface 1906 facing the upper surface 1904 of of the valve bridge 204. Using a suitable fastener 1806 (such as a bolt screwed into a cylinder head or similar fixed structure), the first member 1802 is maintained in a first fixed position relative to the valve bridge 204. In particular, the first fixed position maintains the first member 1802 at a predetermined distance 1908 away from the upper surface 1904 of the valve bridge 204 when the at least two valve bridges 204, 212 are maintained in a closed state. Additionally, as shown, the first fixed position of the first member 1802 is aligned with a first engine valve of the at least two engine valves, where the first engine valve is farthest from a rocker shaft 1808 of the internal combustion engine 202. As shown, the first member 1802 may be configured such that it is aligned with a first engine valve, as described, for more than one valve bridge 204, 212. Further still, the first member 1802 may also extend in this manner across the valve bridges 204, 212 for multiple cylinders of the internal combustion engine, or may comprises multiple such first members 1802 where configuration of the cylinders prevents use of a single first member 1802.

Figure 20:
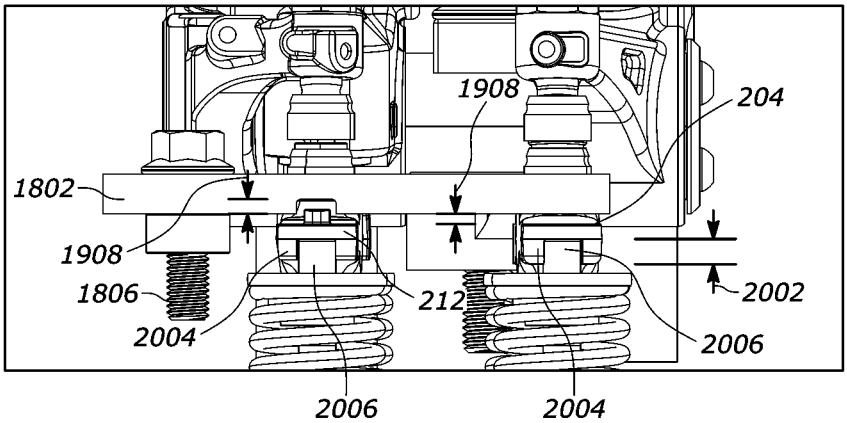

In this, embodiment, the predetermined distance 1908 between the first member 1802 and the upper surface 1904 of the valve bridge 204 is preferably sufficient to prevent contact between the first surface 1906 of the first member 1802 and the upper surface 1904 of the valve bridge 204 when the valve bridge 204 is in a controlled state relative to the at least two engine valves and sufficient to permit contact between the first surface 1906 and the upper surface 1904 to resist uncontrolled movement of the valve bridge 204 when the valve bridge 204 is in an uncontrolled state relative to the at least two engine valves. As used herein, uncontrolled movement of the valve bridge 204 is resisted to the extent that any of the disclosed valve bridge guides oppose movement of the valve bridge 204 outside its normal range of movement when operating in a controlled state. Thus, whereas the multiple variations of the first embodiment illustrated in FIGS. 2-12 oppose movement that would result in tilting or rotation of the valve bridge 204 relative to engine valves, the first member 1802 opposes excessive vertical displacement of the valve bridge 204 relative to the engine valves, particular to prevent complete disengagement of the valve bridge 204 from the engine valves. By defining the predetermined distance 1908 relative to the closed position of the engine valves, contact between the valve bridge 204 and the first member 1802 is avoiding during controlled operation of the valve bridge 204. However, by further defining the predetermined distance 1908 to nevertheless be sufficiently small, the desired resistance to uncontrolled movement of the valve bridge 204 may be provided. In one embodiment, the predetermined distance 1908 may be based on a depth 2002 of a receptacle 2004 provided by the valve bridge 204, 212 to engage valve tips 2006 of the engine valves (FIG. 20). In particular, the predetermined distance 1908 may be chosen to be less than the depth 2002 of the receptacle 2004. In this manner, the valve bridge 204, 212, if operating in an uncontrolled state, will make contact with the first member 1802 before the valve bridge 204, 212 can travel a distance exceeding the depth 2002 of the receptacle 2004, which could otherwise result in disengagement of the valve bridge 204, 212 from the valve tips 2006. Further still, it is known in some forms of engine brakes to actuate only a single, inboard engine valve (i.e., closest to the rocker shaft), which can cause that portion of the valve bridge 204 engaged with the outboard engine valve (i.e., farthest from the rocker shaft) to rise upwards slightly, for example, by about 1-2 mm. Thus, the predetermined distance 1908 should be selected to accommodate this possibility to avoid undesired contact with the valve bridge 204. Additionally, normal wear of engine valve seats could cause an upward rise, over time, of the engine valve tips 2006, and the predetermined distance 1908 should account for this possibility as well.

In this second embodiment, the valve bridge guide may further comprise a second member 1804 maintained in a second fixed position relative to the valve bridge 204 and having a second surface 1910 facing the upper surface 1904 of the valve bridge 204. As with the first member 1802, the second surface 1910 is maintained at the predetermined distance 1908 away from the upper surface 1904 for the same reasons described above. In an embodiment, the second fixed position of the second member 1804 is in alignment with a second engine valve of the at least two engine valves, where the second engine valve is closest to the rocker shaft 1808. Further, as best shown in FIGS. 18 and 19, the second member 1804 may be formed as a unitary structure with a rocker pedestal 1810. In this manner, the first and second members 1802, 1804 may be separately aligned with different engine valves and at the same predetermined distance 1908 from the upper surface 1904, thereby functioning as a valve bridge guide to provide uniform resistance to uncontrolled movement.

Figure 21:
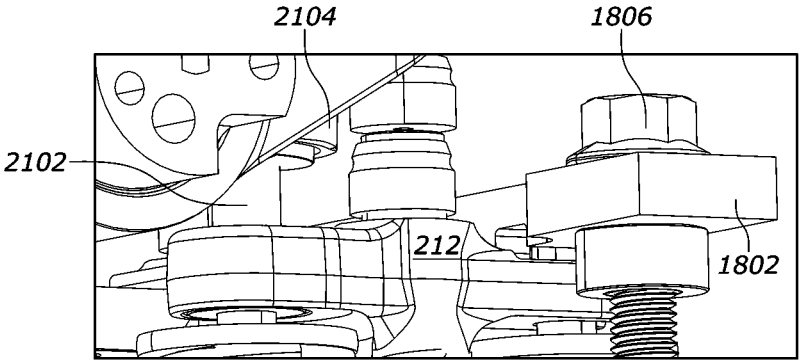

As known in the art, some valve actuation systems include auxiliary motion sources and valve trains that provide auxiliary motion to a single engine valve despite the presence of a valve bridge 212. This is achieved through the use of bridge pin 2102 that, as known in the art, permits auxiliary valve actuation motions to be applied to a single engine valve and main valve actuation motions to also be applied to the singe engine valve via the valve bridge 212. In this case, the presence of the bridge pin 2102, which passes through the valve bridge 212, effectively serves as the second member 1804 defining a valve bridge guide. That is, if the valve bridge 212 is operated in an uncontrolled state, the presence of the bridge pin 2102 (operatively connected to both an auxiliary rocker arm 2104 and the single engine valve) will operate to constrain the valve bridge 212 to only sliding motion relative to the bridge pin 2102. In this case, the presence of the auxiliary rocker arm 2104 (or other auxiliary valve train component) will operate to prevent travel of the valve bridge 212 off of the bridge pin 2102. Once again, where the first member 1802 is provided (as shown in FIG. 21), the joint operation of the first and second members 1802, 1804 will resist uncontrolled movement, particularly upward movement, of the valve bridge 212.

Figure 22:
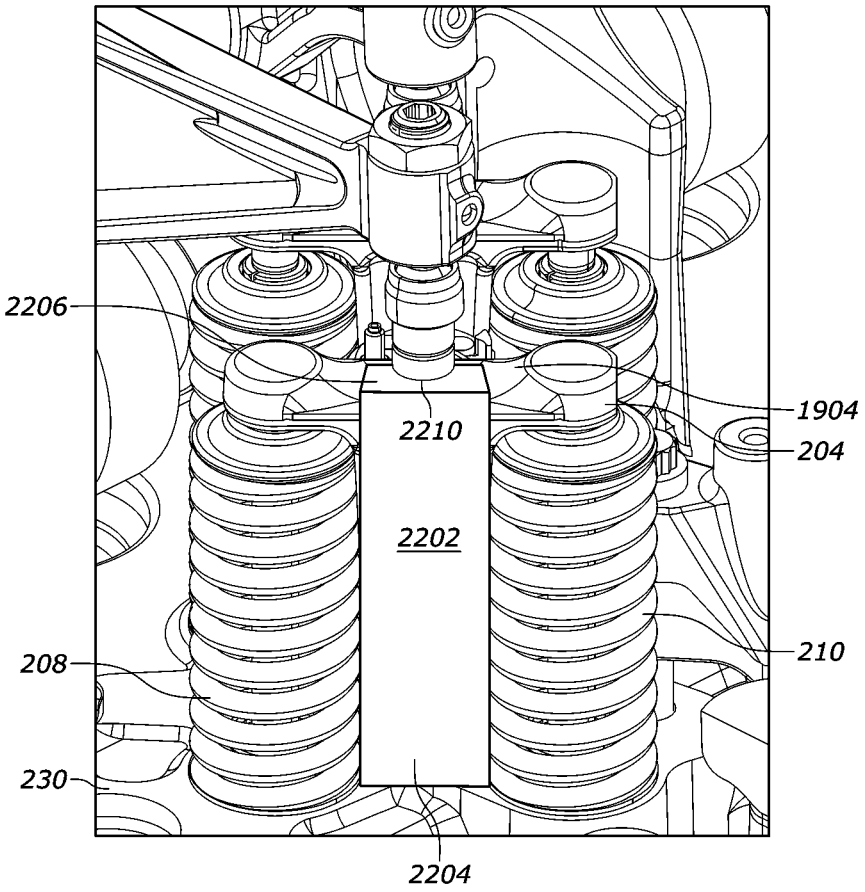
FIG. 22 is a top, isometric view of a valve bridge and valve bridge guide in accordance with a first variation of the second primary embodiment.

FIG. 22 illustrates a first variation of the second embodiment in which a valve bridge guide comprises a first member 2202 formed as a three-sided arch or "strap." Like the embodiment of FIGS. 18-21, the variation illustrate in FIG. 22 operates to resist uncontrolled movement by placing a first member 2202 in a position to contact an upper surface 1904 of the valve bridge 204. In this embodiment, the first member 2202 may comprise sheet metal or similar material having two, substantially vertical elongated sides 2204 (one shown in FIG. 22) extending from above the valve bridge 204 to the base of the engine valve springs 208, 210 where each of the elongated sides 2204 is mounted to the cylinder head 230. Above the highest normal resting point of the valve bridge 204 (i.e., when the engine valves are fully closed) and the upper surface 1904 of the valve bridge 204, a third, substantially horizontal side 2206 of the first member 2202 connects the first and second elongated sides 2204. As with the embodiment of FIGS. 18-21, the third side 2206 is preferably maintained in a fixed position at a predetermined distance 1908 (not shown in FIG. 22) away from the upper surface 1904. As further shown, the third side 2206 includes an opening 2210 that permits a portion of the valve bridge 204 (e.g., with reference to FIG. 1, the outer plunger 720/cap 730) to contact a rocker arm 2212, as shown. In this variation, then, displacement of the valve bridge 204 is constrained by the third side 2206 of the first member 2202 and the opening 2210 formed therein.

Figure 23:
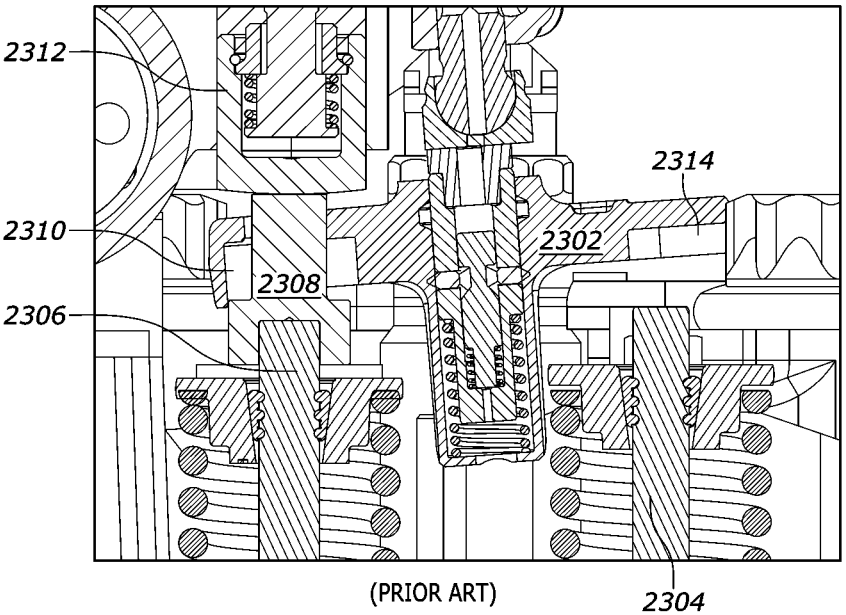
(PRIOR ART) FIG. 23
FIGS. 23 is a cross-sectional view of a valve bridge in accordance with prior art techniques.

FIGS. 23 is a cross-sectional view of a valve bridge illustrating a shortcoming of prior art systems. In particular, FIG. 23 illustrates a valve bridge having a valve bridge body 2302 spanning two engine valve stems 2304, 2306. As shown, a first engine valve 2306 is actuated by an auxiliary rocker arm 2312 via a bridge pin 2308 that receive a stem of the first engine valve 2306. In turn, the bridge pin 2308 is received in a through-bore 2310 formed in the valve bridge body 2302 and aligned with the first engine valve 2306, thereby permitting the bridge pin 2308 to make contact with the auxiliary rocker arm 2312. Additionally, the valve bridge body 2302 includes a receptacle 2314 aligned with a second engine valve 2304 and configured to receive a stem of the second engine valve 2304. In FIG. 23, the valve bridge 2302 is in an uncontrolled state as depicted by receptacle 2314 losing contact with the second engine valve 2304. This results from the fact that there is no surface provided to inhibit the upward travel of the valve bridge 2302 during the uncontrolled state.

Figure 24:
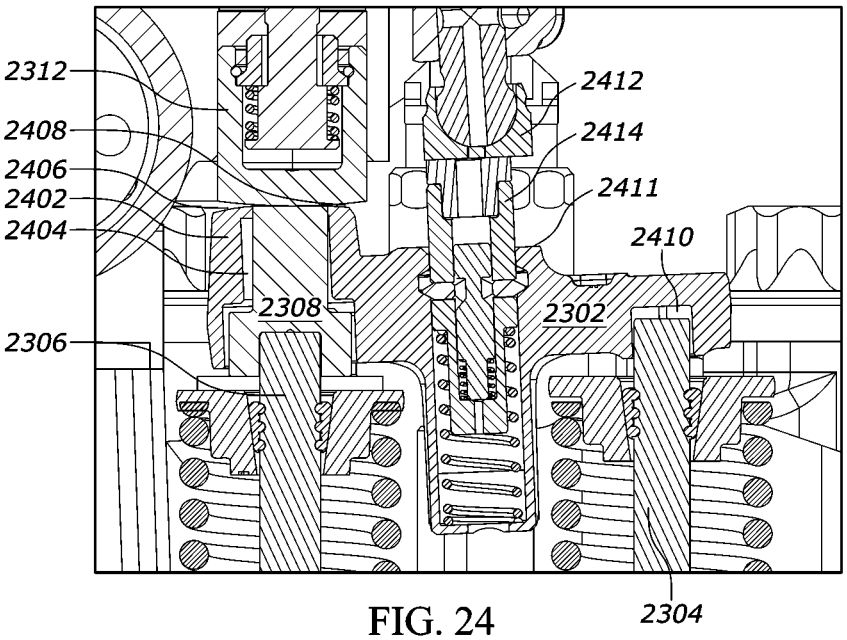
FIG. 24 is a cross-sectional view of a valve bridge in accordance with a third primary embodiment

FIG. 24 illustrates a valve bridge in accordance with a third primary embodiment in which a valve bridge substantially similar to that depicted in FIG. 23 is shown. In this case, however, the valve bridge also includes a bridge pin boss 2402 having the through-bore 2404 formed therein, and having a larger longitudinal length (or height) as compared to the embodiment illustrated in FIG. 23. As a consequence, an upper surface 2406 of the bridge pin boss 2402 is in closer proximity to a lower surface 2408 of the auxiliary rocker arm 2312 (e.g., a lower surface of an actuator in the depicted embodiment). Thus, when the valve bridge is in an uncontrolled state resulting in upward movement of the valve bridge body 2302, the upper surface 2406 of the bridge pin boss 2402 will come into contact with the lower surface 2408 of the auxiliary rocker arm 2312 before the valve bridge body 2302 has a chance to completely disengage from the valve stems. This is illustrated in FIG. 24 where contact between the upper surface 2406 and the lower surface 2408 prevents complete disengagement of the receptacle 2410 from the stem of the second engine valve 2304.

It is also understood that a similar upper surface of that portion of the valve bridge body 2302 aligned with a main rocker arm 2412 may also be configured in a manner similar to the upper surface 2406 of the bridge pin boss 2402. In this case, the height of the valve bridge body 2302 aligned with the main rocker arm 2412 may be similarly increased such that an upper surface 2411 of the valve bridge body 2302 is likely to contact the main rocker arm 2412 (e.g., a lower surface of swivel foot in the depicted embodiment) during uncontrolled movement of the valve bridge body 2302. In this case, however, the height of the upper surface 2411 must be selected so as to no interfere with the ability of the collapsing mechanism 2414 to fully absorb any valve actuation motions provided by the main rocker arm 2412. In other words, the upper surface 2411 should not be increased to the point that it makes contact with the main rocker arm 2412 during a controlled state (or controlled movement) of the valve bridge body 2302 and when the collapsing mechanism 2414 is absorbing the main valve events.

Figure 25:
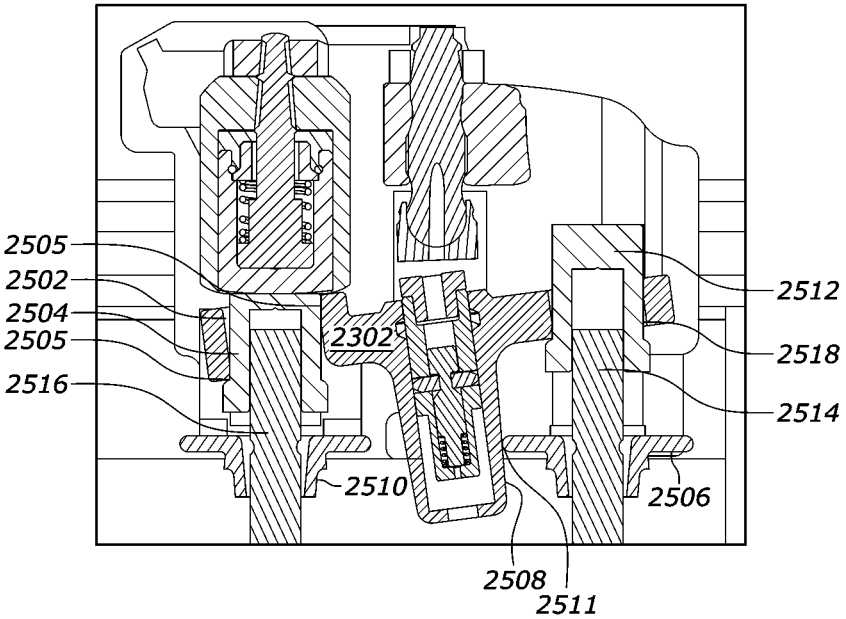
FIG. 25 is a cross-sectional view of a valve bridge in accordance with fourth through sixth primary embodiments.

Referring now to FIG. 25, a valve bridge in accordance with fourth through sixth primary embodiments is illustrated. In particular, FIG. 25 once again illustrates a valve bridge similar in construction to the valve bridge illustrated in FIG. 23. The fourth primary embodiment concerns the feature of clearance between the inner diameter of the through-bore 2502 and the outer diameter of the bridge pin 2504. In particular, by tightly controlling and minimizing the clearance between the through-bore and bridge pin, the occurrence of uncontrolled movement will result in "pinching" (or jamming) of the valve bridge body 2302 and the bridge pin 2504. This is illustrated in FIG. 25 by contact points 2505 between the through-bore 2502 and the bridge pin 2504. In turn, this pinching attenuates any further travel of the valve bridge body 2302, thereby tending to keep the valve bridge body 2302 in alignment with the engine valves.

FIG. 25 further illustrates the fifth primary embodiment to the extent that it depicts an increased-radius spring retainer 2506 (relative to the radius of a typical spring retainer 2510, i.e., comparable to the radius of valve springs (not shown)). In this embodiment, the increased-radius spring retainer 2506 permits that portion 2508 of the valve bridge body 2302 extending between the engine valve stems to more quickly make contact 2511 with the increased-radius spring retainer 2506 during uncontrolled movement (particularly, rotation of the valve bridge body 2302), thereby resisting further rotation of the valve bridge body 2302.

Further still, FIG. 25 further illustrates the sixth primary embodiment in that it shows extended valve stem features. In the illustrated embodiment, the extended valve stem features takes the form of bridge pin 2512 residing in a second through-bore 2518. As shown, the bridge pin 2512 is free to travel up and down on an engine valve stem 2514. In this case, when the valve bridge body 2302 is in an uncontrolled state, the bridge pin 2512 is free to travel upward with the valve bridge body 2302. So long as the bridge pin 2512 remains seated on the engine valve stem 2514, notwithstanding uncontrolled movement of the bridge pin 2512 and valve bridge body 2302, the bridge pin 2512 maintains alignment of the valve bridge body 2302 with the engine valve stems 2514, 2516. The same principle of controlled movement on an engine valve stem 2516 may be equally applied to the bridge pin 2504 aligned with an auxiliary rocker arm, as shown. In this embodiment, it may be desirable for the either or both of the engine valve stems 2514, 2516 to have an extended length above the spring retainers 2506, 2512, e.g., up to 10 mm as compared to a more typical length of 2-3 mm.

Figure 26:
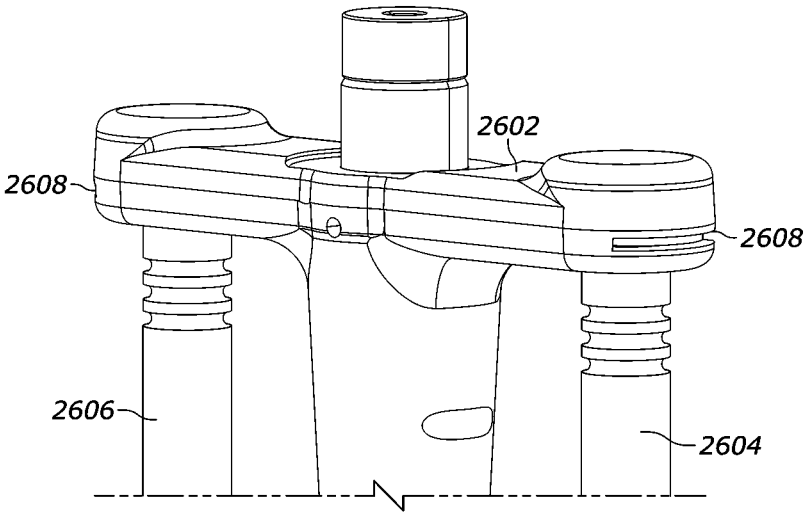
FIGS. 26-28 are respective top, isometric and cross-sectional views of a valve bridge in accordance with a seventh primary embodiment.
Figure 27:
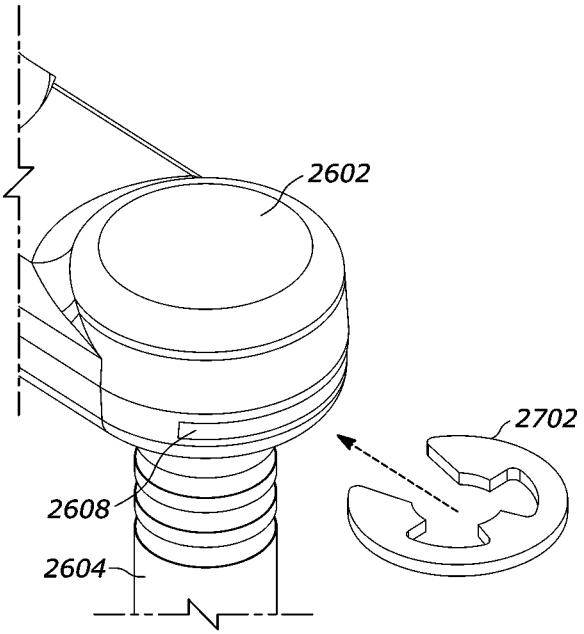
Figure 28:
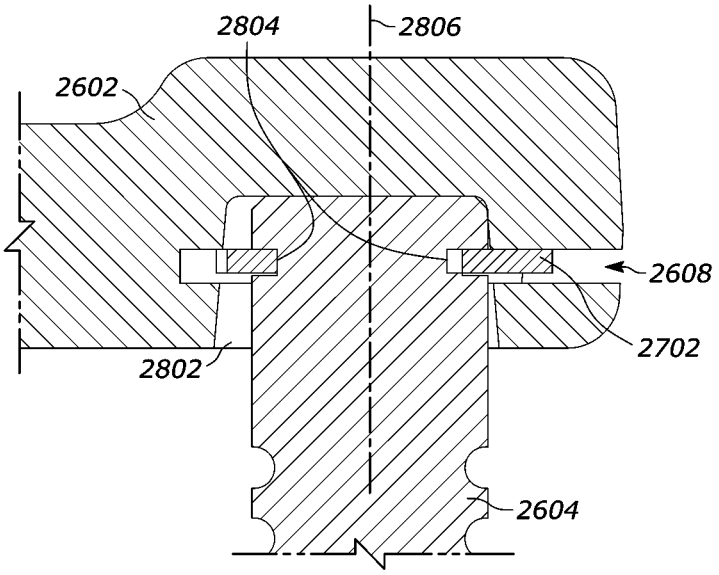

FIGS. 26-28 illustrate a valve bridge in accordance with a seventh primary embodiment. In accordance with typical valve bridges, the illustrated valve bridge includes a valve bridge body 2602 spanning at least two engine valves 2604, 2606. In this embodiment, slots 2608 are formed in those portions of the valve bridge body 2602 configured to contact the stems of the engine valves 2604, 2606. In particular, as best shown in FIG. 28, the slots 2608 may comprise laterally-extending slots that transversely intersect receptacles 2802 and longitudinal axes 2806 of the engine valve stems 2604 (only one shown in FIG. 28). When an engine valve stem 2604 is aligned with and inserted into the corresponding receptacle 2802, an annular channel 2804 formed in the engine valve stem 2604 aligns with the slot 2608. A C-clip 2702 is inserted into the slot 2608 and engages the annular channel 2804 such that the C-clip 2702 is retained on the engine valve stem 2604. Once retained on the engine valve stem 2604, further engagement of the C-clip 2702 with the slot 2608 allows the C-clip 2702 to resist disengagement of the engine valve stem 2604 from the receptacle 2802, for example, during uncontrolled movement of the valve bridge body 2602. Although the slots 2608 are illustrated in FIGS. 26-28 as extending laterally away from the valve bridge body 2602, this is not a requirement. For example, the slots 2608 could instead extend perpendicularly from the plane of FIG. 28, i.e., perpendicular to a longitudinal axis of the valve bridge body and perpendicular to the longitudinal axes 2806 of the engine valve stems 2604, 2606.

Figure 29:
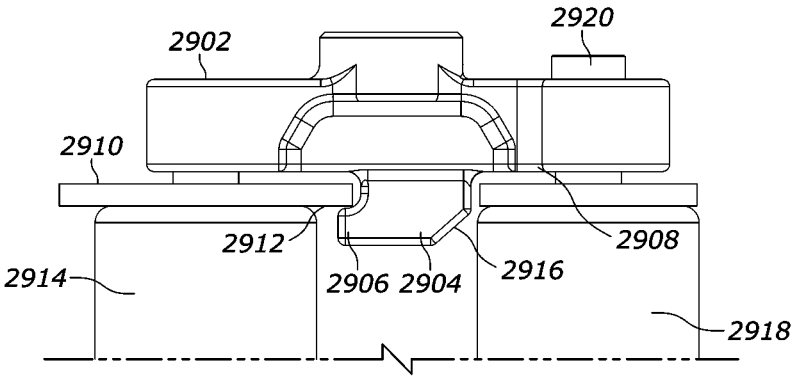
FIG. 29 is a side view of a valve bridge in accordance with an eighth primary embodiment.

FIG. 29 is a side view of a valve bridge in accordance with an eighth primary embodiment. In this embodiment, a valve bridge body 2902 comprises a protrusion 2904 extending downward from a lower surface 2908 of the valve body 2902 and positioned between the at least two engine valve stems (not shown). As further shown, the protrusion 2904 further comprises at least one hook feature 2906 (only one shown) extending away from the protrusion 2904 toward and below at least one spring retainer 2910 such that the hook or latching feature 2906 extends past an outer circumference of the at least one spring retainer 2910. When the valve bridge body 2902 is in an uncontrolled state, the hook feature 2906 will contact the underside 2912 of the valve spring retainer 2910 and prevent the valve bridge body 2902 from separating from the engine valve stems to the point that the valve bridge body is completely disengaged from the engine valve stems. Like the fifth embodiment described above relative to FIG. 25, an increased-radius spring retainer 2910 can provide a protruding rim of material that extends beyond the outer circumference of the corresponding valve spring 2914. In this manner, the hook feature 2906 is better able to engage the spring retainer 2910 and thereby better ensure resistance to valve bridge disengagement.

As further shown in FIG. 29, the peripheral shape 2916 of the protrusion 2904 is configured to allow the valve bridge body 2902 to move downward on one of the engine valves (rightmost, as depicted in FIG. 29, as in the case of auxiliary valve actuation motions) and tilt without contacting the springs 2914, 2918. Based on the illustrated configuration, installation of the valve bridge is facilitated by installing the left side first, and then rotating the valve bridge downward onto the rightmost engine valve stem (and corresponding bridge pin 2920). While the bridge pin 2920 is held down by a separate auxiliary rocker or integrated actuator piston thereof (not shown), the bridge cannot be removed due the latching effect of the hook feature 2906.

Figure 30:
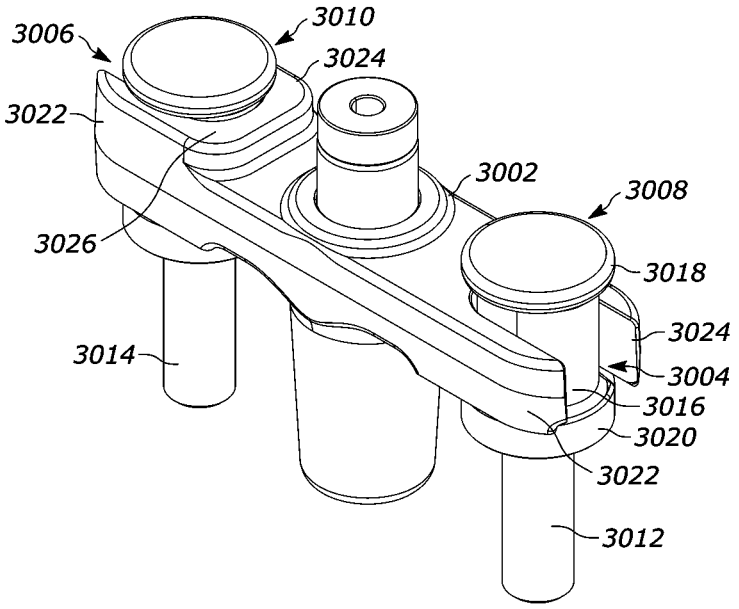
FIGS. 30 and 31 are respective isometric and cross-sectional views of a valve bridge and bridge pin in accordance with a ninth primary embodiment.
Figure 31:
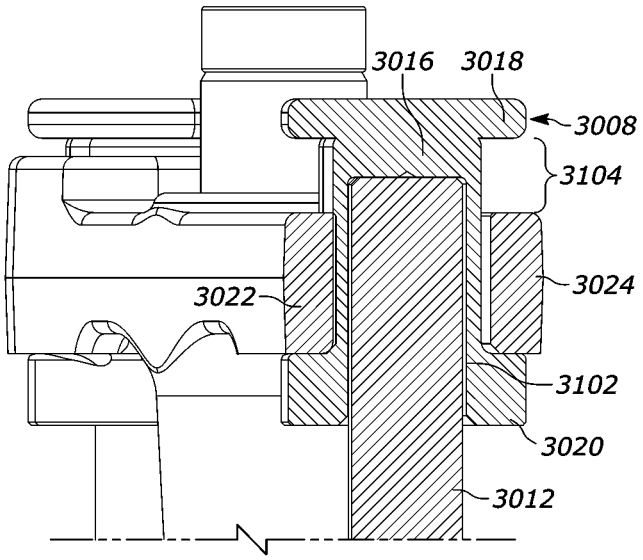

FIGS. 30 and 31 illustrate a valve bridge and bridge pin in accordance with a ninth primary embodiment. In this embodiment, the valve bridge body 3002 comprises open, laterally-extending slots 3004, 3006 configured to receive corresponding bridge pins 3008, 3010 between respective arms 3022, 3024 defined by slots 3004, 3006 extending into the valve body 3002. As best shown in FIG. 31, each bridge pin 3008, 3010 has a receptacle 3102 formed therein and configured to receive a corresponding engine valve stem 3012. As shown, each of the bridge pins 3008, 3010 has a spool-like shape comprising a barrel body 3016 and increased-diameter (relative to the barrel body 3016) end caps 3018, 3020. The slots 3004, 3006 are configured such that the arms 3022, 3024 maintain relatively close clearance to the barrel body 3016 of their respective bridge pin 3008, 3010. On the other hand, the slots 3004, 3006 are configured such that the arms 3022, 3024 will make contact with the end caps 3018, 3020. In this manner, vertical movement of the bridge pins 3008, 3010 is constrained by spacing 3104 between the upper (and/or lower) surfaces of the arms 3022, 3024 and the complementary surfaces defined by the end caps 3018, 3020. In this manner, if the valve bridge body 3002 experiences uncontrolled movement, the constraints placed on the valve bridge body 3002 by the bridge pins 3008, 3010 prevents disengagement from the engine valve stems 3012, 3014. It is noted that, like the third primary embodiment illustrated in FIG. 24, an upper surface 3026 of the valve bridge body 3002 may be configured such that the spacing between the upper surface 3026 and end cap 3010 is configured to limit upward travel of the valve bridge body 3002 even further.

Figure 32:
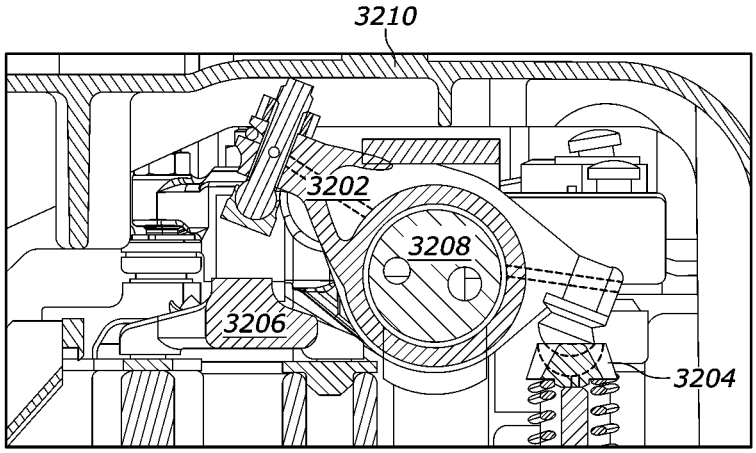
FIG. 32 is side, partial cross-sectional view of a valve actuation system in accordance with prior art techniques.

FIG. 32 illustrates a valve actuation system in accordance with prior art techniques. In particular, valve actuation systems are known in which a collapsing mechanism similar to that shown in FIG. 1 is deployed in a rocker arm 3202 or pushrod 3204, rather than a valve bridge 3206 as depicted in many of the previously-described embodiments. As known in the art, the rocker arm 3202 is well engaged on a rocker shaft 3208, however such valve actuation systems present the opportunity for the valve bridge 3206 to enter into an uncontrolled state if excessive lash forms in the valvetrain. For example, a sudden collapse in the pushrod 3204 could allow the rocker to rotate backwards (i.e., toward the pushrod 3204) equal to the valve lift that was suddenly eliminated. If the valve lift thus lost was relatively high (e.g., 14 mm in some systems), the sudden backward rotation of the rocker arm 3202 could cause the rocker arm 3202 to hit a valve cover 3210 or other object. Because the rocker arm 3202 is normally relied upon to maintain engagement of the valve bridge 3206 with the engine valve stems, the sudden backward rotation of the rocker arm 3202, combined with the rapid acceleration of the valve bridge 3206 under the influence of the valve springs will cause the valve bridge to move in an uncontrolled manner, possible resulting in dislodgement.

Figure 33:
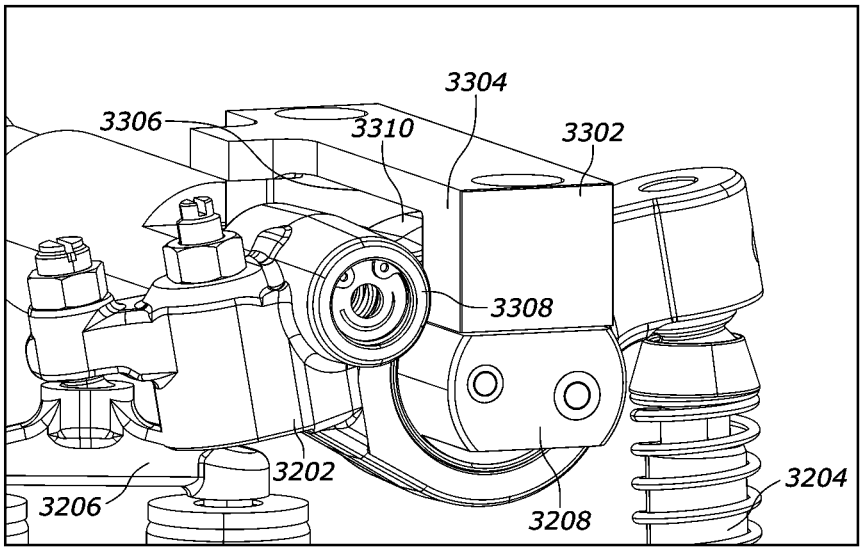
FIG. 33 is a top, isometric view of a valve actuation system in accordance with a tenth embodiment.

To prevent the valve bridge 3206 from disengaging in such circumstances, a stop may be provided to prevent excessive rotation of the rocker arm 3202 that would otherwise allow valve bridge 3206 to escape. An example of this is illustrated in FIG. 33 in which a rigid or fixed block 3302 deployed to prevent backward over-rotation of the rocker arm 3202. In the illustrated embodiment, the fixed block 3302 is rigidly attached to the rocker shaft 3208 and comprises, in this example, both vertical 3304 and horizontal 3306 surfaces configured to engage with surfaces of the rocker arm 3202 to prevent over-rotation thereof. The fixed block 3302 is configured such that vertical and horizontal surfaces 3304, 3306 do not interfere with the normal reciprocation (i.e., in a controlled state) of the rocker arm 3202. However, the fixed block 3302 is also configured such that vertical and horizontal surfaces 3304, 3306 are positioned to prevent over-rotation of the rocker arm 3202.

For example, the illustrated rocker arm 3202 may include a rear-facing surface 3308 defined, in this case, by a control valve boss formed in rocker arm 3202. In the event of sudden backward rotation, the rear-facing surface 3308 will contact the vertical surface 3304 and prevent over-rotation of the rocker arm 3202. Similarly, the rocker arm further comprises an upward-facing surface 3310. In the event of sudden backward rotation, the upward-facing surface 3310 will contact the horizontal surface 3306 and prevent over-rotation of the rocker arm 3202. Though the illustrated embodiment includes both the vertical and horizontal surfaces 3304, 3306, this is not a requirement as it is anticipated that either such surface could be sufficient to prevent over-rotation depending on the configuration of the rocker arm 3202.

Figure 34:
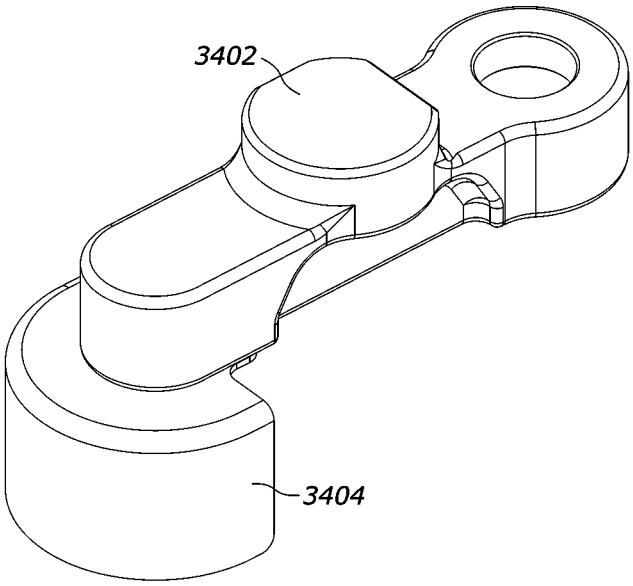
FIGS. 34 and 35 are respective top and bottom isometric views of a valve bridge and valve bridge guide in accordance with an eleventh embodiment.
Figure 35:
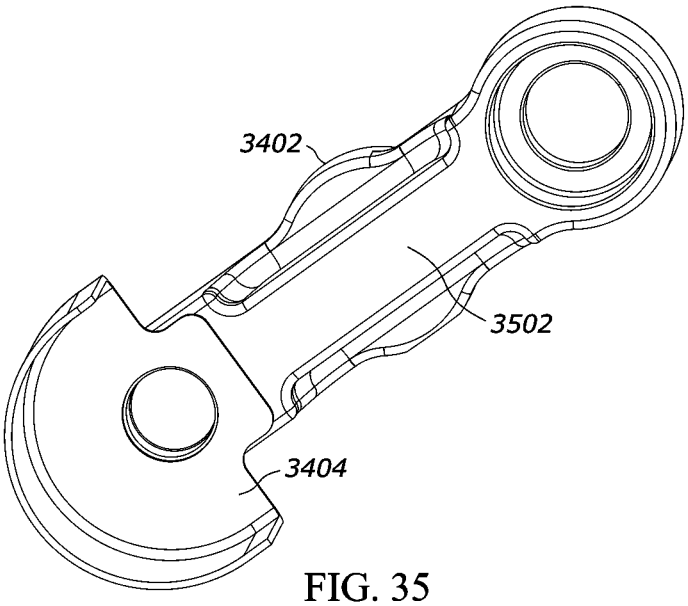

FIGS. 34 and 35 illustrate a valve bridge and valve bridge guide in accordance with an eleventh embodiment. In this embodiment, a valve bridge guide 3404 is provided that is attached to (or integrally formed with) a valve bridge body 3402. As shown, the valve bridge guide 3404 is deployed on a side of the valve bridge body 3402 that is not intended to engage with an engine valve (not shown) that is also capable of being actuated by an auxiliary motion source. In the illustrated embodiment, the valve bridge guide 3404 is shaped as a half-cylinder wall configured to be attached to a lower surface 3502 of the valve bridge body 3402 such that the half-cylinder wall extends downward from the lower surface 3502. However, it is understood that the valve bridge guide 3404 could be attached at some other surface (e.g., an upper surface) of the valve bridge body 3402, so long as the half-cylinder wall extends downward below the lower surface 3502 as shown.

Figure 36:
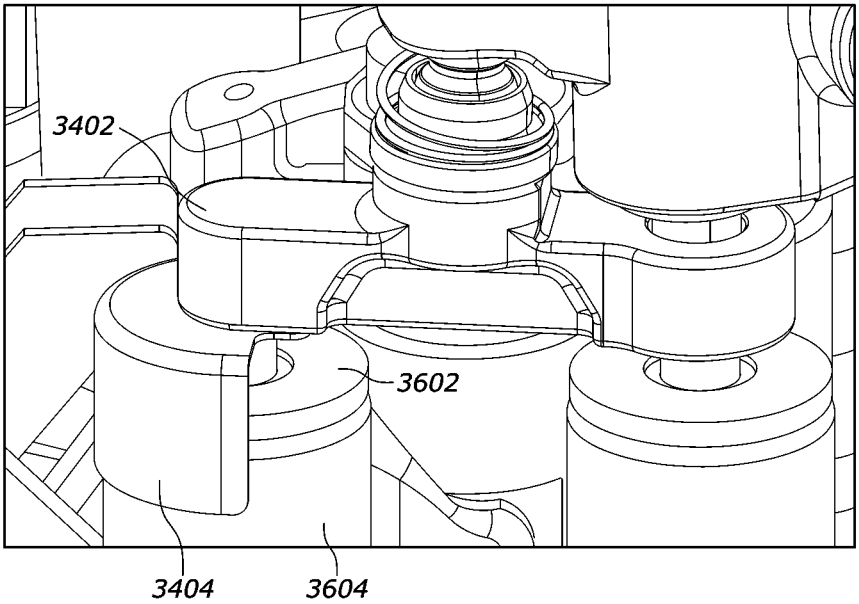
FIG. 36 is a top, isometric view of the valve bridge and valve bridge guide of FIGS. 34 and 35 deployed in a valve actuation system.

FIG. 36 illustrates the valve bridge and valve bridge guide of FIGS. 34 and 35 deployed in a valve actuation system. As shown, the valve bridge body 3402 spans two engine valve stems and the valve bridge guide 3404 encompasses an outer, lateral portion of a valve spring retainer 3602. A radius of the half-cylinder wall (preferably centered on or near a longitudinal axis of the corresponding engine valve stem) is configured such that, during normal (i.e., controlled) operation of the valve bridge, no contact is made between the half-cylinder wall and the valve spring retainer 3602 or the corresponding valve spring 3604. On the other hand, the radius of the half-cylinder wall is further configured such that, during an uncontrolled state of the valve bridge body 3402, the half-cylinder wall will contact the valve spring retainer 3602 but avoid contact with the valve spring 3604. Like the embodiments described above relative to FIGS. 25 and 29, an increased-radius spring retainer could be employed to better ensure contact between the valve spring retainer 3602 and the valve bridge guide 3404 (and, preferably, not the valve spring 3604).

As set forth above, the instant disclosure describes various embodiments and variations for a valve bridge guide that may be used to resist, i.e., prevent, minimize or accommodate, uncontrolled movement of a valve bridge. While various features have been described in conjunction with specific embodiments, those skilled in the art will appreciate that various ones of such features may be incorporated into other embodiments described herein.

What is claimed is:

1. A valve bridge for use with an engine valve assembly of an internal combustion engine, the engine valve assembly comprising at least two engine valves, wherein the at least two engine valves are actuated by a main rocker arm and a first engine valve of the at least two engine valves is actuated by an auxiliary rocker arm via a bridge pin, the valve bridge comprising:

a valve bridge body configured to extend between the at least two engine valves, the valve bridge body comprising a through-bore configured to align with the first engine valve and to receive the bridge pin, the valve bridge body further comprising a receptacle configured to align with a second engine valve of the at least two engine valves and to receive a stem of the second engine valve; and an upper surface formed on the valve bridge body and having a height such that the upper surface contacts a surface of the main rocker arm or the auxiliary rocker arm so as to resist uncontrolled movement of the valve bridge when the valve bridge is in an uncontrolled state relative to the at least two engine valves.

2. The valve bridge of claim 1, wherein the valve bridge further comprises:

a bridge pin boss having the through-bore formed therein, the bridge pin boss terminating in the upper surface.

3. The valve bridge of claim 1, wherein the valve bridge further comprises:

a portion of the valve bridge body aligned with the main rocker arm terminating in the upper surface.

* * * * *